US011976477B2

(12) United States Patent
Becker

(10) Patent No.: US 11,976,477 B2
(45) Date of Patent: May 7, 2024

(54) FORMWORK SYSTEM

(71) Applicant: Brand Shared Services LLC, Kennesaw, GA (US)

(72) Inventor: Allan James Becker, Richmond Hill (CA)

(73) Assignee: Brand Shared Services LLC, Kennesaw, GA (US)

( * ) Notice: Subject to any disclaimer, the term of this patent is extended or adjusted under 35 U.S.C. 154(b) by 277 days.

(21) Appl. No.: 17/421,772

(22) PCT Filed: Jan. 17, 2020

(86) PCT No.: PCT/US2020/013975
§ 371 (c)(1),
(2) Date: Jul. 9, 2021

(87) PCT Pub. No.: WO2020/150539
PCT Pub. Date: Jul. 23, 2020

(65) Prior Publication Data
US 2022/0081917 A1 Mar. 17, 2022

(51) Int. Cl.
*E04G 11/48* (2006.01)
*E04G 11/50* (2006.01)
(Continued)

(52) U.S. Cl.
CPC ..... *E04G 11/486* (2013.01); *E04G 11/50* (2013.01); *E04G 17/005* (2013.01); *E04B 5/32* (2013.01); *E04G 2025/006* (2013.01)

(58) Field of Classification Search
CPC ..... E04G 11/50; E04G 11/486; E04G 11/483; E04G 17/005; E04G 11/38; E04G 2025/006
See application file for complete search history.

(56) References Cited

U.S. PATENT DOCUMENTS 1,907,877 A * 5/1933 Roos ..... E04G 11/486 249/193
3,434,689 A 3/1969 Aftreth
(Continued)

FOREIGN PATENT DOCUMENTS

CA 2475339 A1 * 12/2004 ..... E04G 11/38
CA 2988166 A1 * 3/2019 ..... E04G 11/483
(Continued)

OTHER PUBLICATIONS

Extended European Search Report issued by the European Patent Office dated Sep. 15, 2022 in connection with European Patent Application No. 20741609.0, 7 pages.
(Continued)

*Primary Examiner* — Michael Safavi
(74) *Attorney, Agent, or Firm* — DINSMORE & SHOHL LLP

(57) ABSTRACT

A formwork system includes a height-adjustable support for supporting a beam in substantially horizontal or slightly inclined position that includes a support with a central upstanding member and a support arm. The support arm has a rounded socket, and the beam has a cylindrical mounting pin proximate its end. The socket and mounting pin are shaped and sized so that the mounting pin is retained within the socket and they together form a hinge joint. As the mounting pin is retained by the socket of the support arm, it does not shift laterally relative to the support arm as the support arm is vertically adjusted. The variance in the gap between laterally secured forming panels as a response to vertical shift of the support is dependent on the incline angle of the beam and the dimensions of the beam and the support arm. This is predictable within a defined tolerance.

13 Claims, 28 Drawing Sheets

(51) Int. Cl.

| | |
|---|---|
| ***E04G 17/00*** | (2006.01) |
| *E04B 5/32* | (2006.01) |
| *E04G 25/00* | (2006.01) |

(56) References Cited

U.S. PATENT DOCUMENTS

| | | | | |
|---|---|---|---|---|
| 10,053,875 | B1 * | 8/2018 | Baron | E04G 11/486 |
| 2006/0042179 | A1 * | 3/2006 | Vanagan | E04G 11/56 52/633 |
| 2019/0277044 | A1 * | 9/2019 | Faresin | E04G 11/50 |

FOREIGN PATENT DOCUMENTS

| | | | | |
|---|---|---|---|---|
| DE | 4204773 | A1 * | 8/1993 | E04G 11/486 |
| DE | 4305301 | A1 | 8/1994 | |
| DE | 102006055306 | A1 * | 5/2008 | E04G 11/483 |
| EP | 1251222 | A2 | 10/2002 | |
| EP | 2154315 | A1 | 2/2010 | |
| EP | 3202998 | A1 | 8/2017 | |
| JP | 59167147 | U | 11/1984 | |
| WO | 2015090995 | A1 | 6/2015 | |
| WO | 2019202623 | A1 | 10/2019 | |
| WO | WO-2019202623 | A1 * | 10/2019 | E04G 17/005 |

OTHER PUBLICATIONS

International Search Report and Written Opinion dated Apr. 8, 2020 pertaining to International application No. PCT/US20/13975 filed Jan. 17, 2020, 9 pages.

* cited by examiner

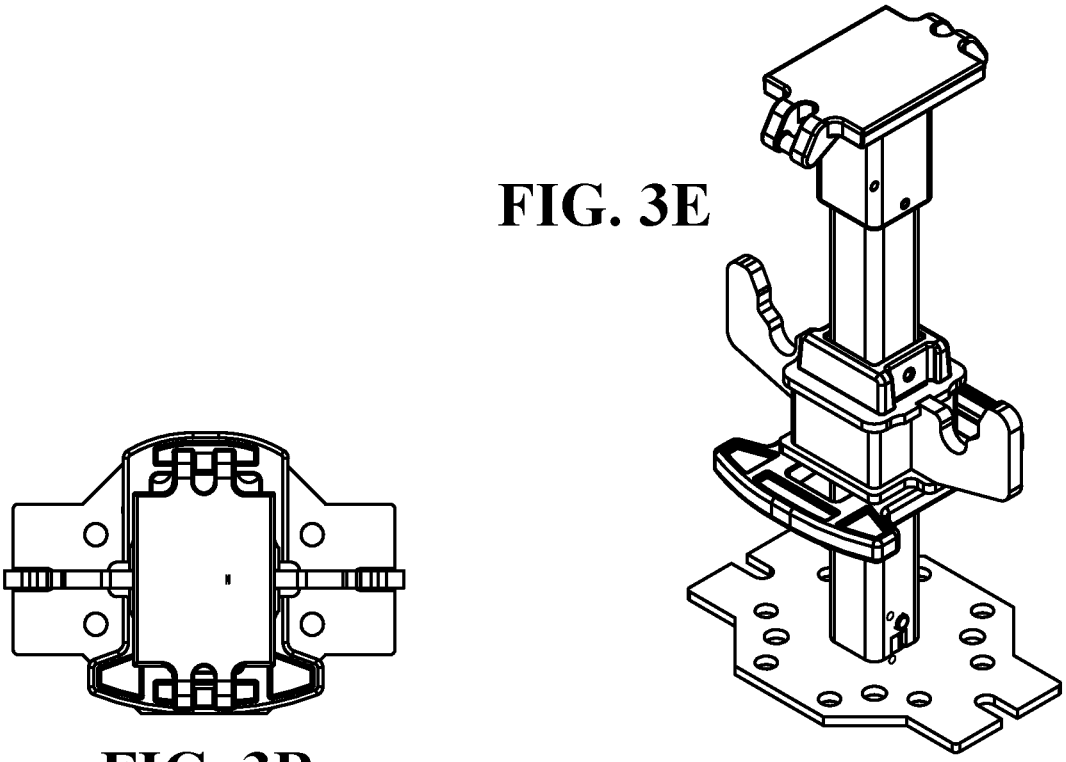
FIG. 3E
FIG. 3B
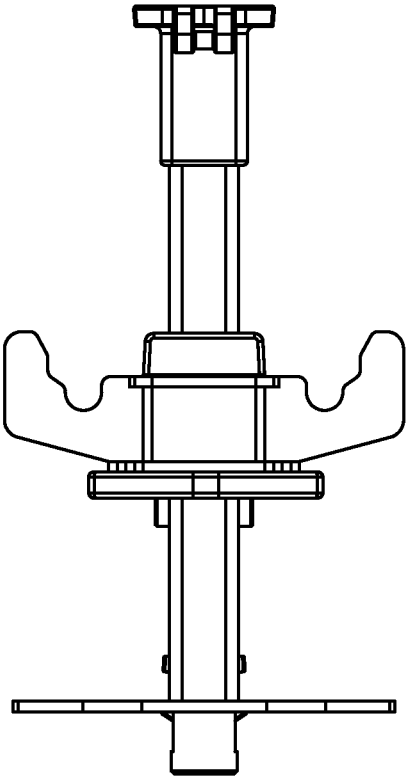
FIG. 3C
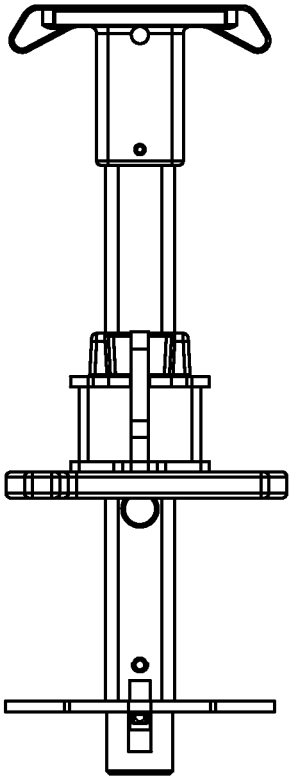
FIG. 3D

FORMWORK SYSTEM

CROSS REFERENCE TO RELATED APPLICATIONS

This application claims priority to Canadian Patent Application No. 3030905, filed Jan. 18, 2019, the entire disclosure of which is hereby incorporated by reference.

FIELD

A formwork system for supporting forming panels to form a horizontal concrete surface.

BACKGROUND

Formwork systems provide a temporary mold into/onto which liquid concrete can be poured. After the liquid concrete sets, the formwork may be removed, leaving behind a concrete structure. Formwork systems are used in building numerous types of structures, including buildings, bridges, parking garages, and so forth.

Formwork systems may be used to form vertical concrete structures as well as horizontal concrete surfaces. Formwork systems may also be used to form inclined concrete surfaces, for example, by inclining beams used to support forming panels. Inclined surfaces are useful in many applications, for example, to form ramps in parking garages.

However, traditional formwork systems are ill-suited for forming inclined surfaces. One problem with traditional formwork system is that gaps may form between forming panels. For example, a forming panel suspended by a first beam should not touch a forming panel suspended on an adjacent beam. Such gaps between panels are typically filled with thin strips that span the width of the forming panels (also known as 'compensation-strips').

Accordingly, improvements in formwork systems are desirable.

SUMMARY

In accordance with an aspect of the present disclosure, there is provided a formwork system for supporting one or more forming panels to form a generally horizontal concrete surface, said formwork system comprising: a plurality of supports each comprising: a vertically extending post; a drop head mounted on the vertically extending post, for supporting first and second transverse beams between adjacent ones of the plurality of supports; first and second sockets formed on said drop head, each formed on opposite sides of said vertically extending post at defined distances from said vertically extending post, each of the first and second sockets for receiving a mounting pin of the transverse beams, each mounting pin comprising a rounded contact surface; each of said first and second sockets permitting rotation of a received mounting pin about a pin axis while retaining the received mounting pin so that its axis of rotation remains substantially invariant as the received mounting pin rotates in the socket, while the drop head remains stationary.

A formwork system for supporting one or more forming panels to form a generally horizontal concrete surface, said formwork system comprising: a plurality of supports each comprising: a vertically extending post; a drop head mounted on the vertically extending post, for supporting first and second transverse beams between adjacent ones of the plurality of supports; first and second sockets formed on said drop head, each formed on opposite sides of said vertically extending post at defined distances from said vertically extending post, each of the first and second sockets for receiving a complementary mounting pin of one of the first and second transverse beams to each form a hinged joint connecting said support to said first or second beams.

Other aspects, features, and embodiments of the present disclosure will become apparent to those of ordinary skill in the art upon review of the following description of specific embodiments in conjunction with the accompanying figures.

BRIEF DESCRIPTION OF DRAWINGS

In the figures, which illustrate, by way of example only, embodiments of the present disclosure.

FIG. 3B is an top view of a support of FIG. 3A;

FIG. 3C is a side view of the support of FIG. 3A;

FIG. 3D is a second side view of the support of FIG. 3A;

FIG. 3E is a top-perspective view of the support of FIG. 3A;

DETAILED DESCRIPTION

Figure 1A:
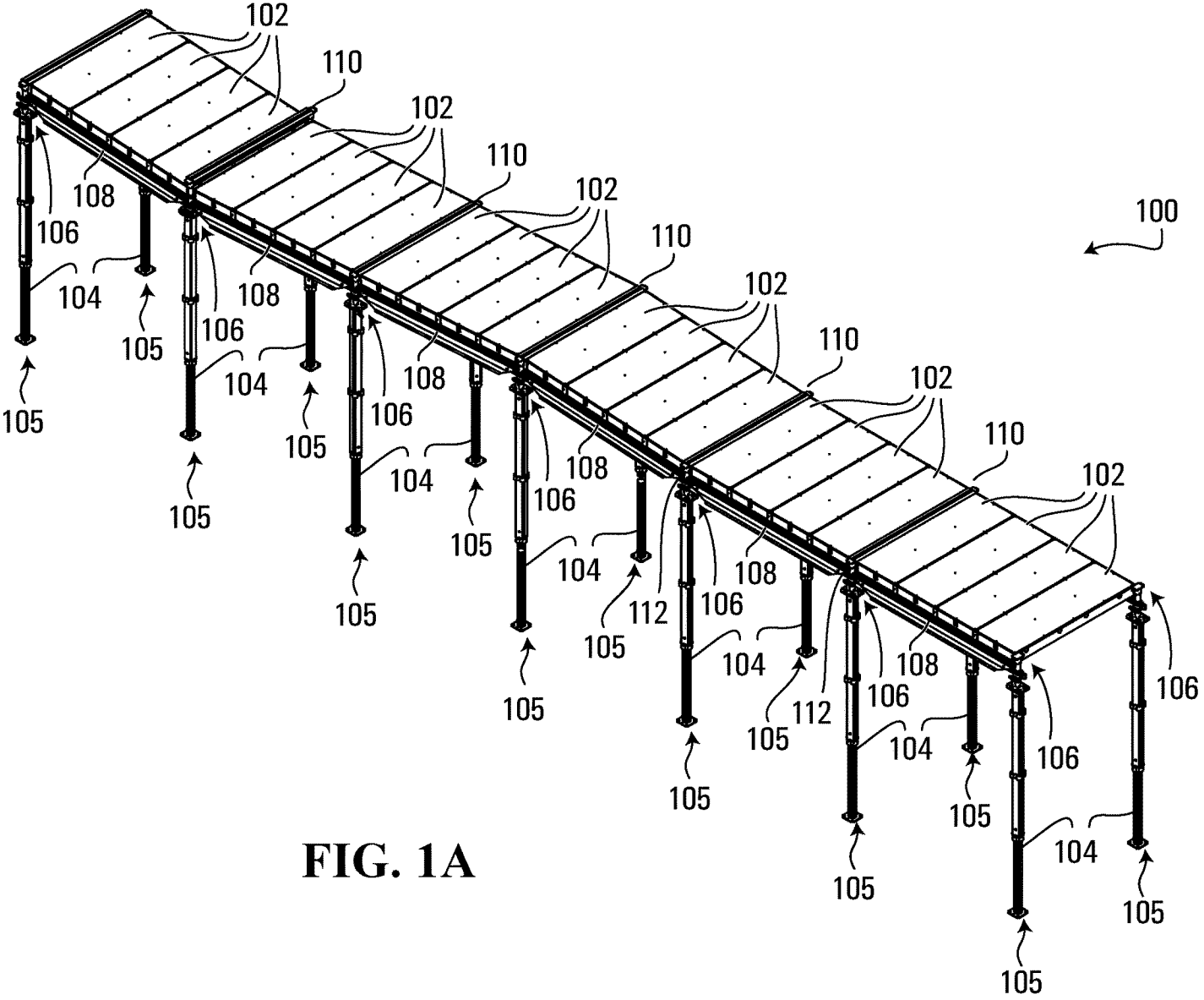
FIG. 1A is a top-perspective view of a formwork system 100 in accordance with an example embodiment.

When formwork systems are used form inclined surfaces, different sized gaps may result between forming panels. In conventional formwork systems, forming panels are typically laterally secured to beams of the formwork system to prevent the beams from sliding along the beams. In such systems, the lateral position of forming panels along the beams cannot be adjusted when beams are inclined. As such, there may be large gaps between some forming panels and small gaps between other forming panels. Such systems are therefore ill suited for forming inclined surfaces.

In other systems, forming panels may be laterally unsecured to the beams. A worker can thus adjust the lateral position of the forming panels along the beams to accommodate inclined beams to maintain panel gaps at a substantially constant size. However, laterally unsecured forming panels may create a safety hazard as workers may walk on the forming panels. If a forming panel slides as a worker steps on the panel, the worker may fall and sustain an injury.

Disclosed is a formwork system adapted for forming concrete surfaces that transition from level to sloping (or vice-versa). In particular, the formwork system includes a height-adjustable support for supporting a beam in substantially horizontal, or slightly inclined position. The support includes a central upstanding member and a support arm. The support arm has a rounded socket, and the beam has a cylindrical mounting pin proximate an end. The socket and mounting pin are shaped and sized so that the mounting pin fits within the socket and they together form a hinge joint. As the support is adjusted vertically, the mounting pin rotates about its axis but is retained within the socket such that its axis of rotation remains substantially invariant for different rotational positions (corresponding to different angles of inclination of the beam). As the beam has a fixed length, inclining the beam by pivoting one end of the beam about a fixed point would result in a lateral shift of the opposite end of the beam. To compensate for this, the support arm may be loosely coupled to central upstanding member, so that the lateral shift of the beam can be offset by small lateral movements by the support arm relative to the central upstanding member. Further, the support itself may shift laterally in response to a vertical movement of the support arm to accommodate the lateral shift of the beam. As the mounting pin of the beam is retained by the socket of the support arm, the mounting pin does not shift laterally or horizontally relative to the support arm when the support arm moves up or down vertically. Thus, and as will be explained in greater detail below, the variance in the gap between laterally secured forming panels as a response to vertical shift of the support is dependent on the incline angle of the beam and the dimensions of the beam and the support arm. This is predictable within a defined tolerance. As a result, a single type of compensation-strip can be selected for use with the system.

Figure 1B:
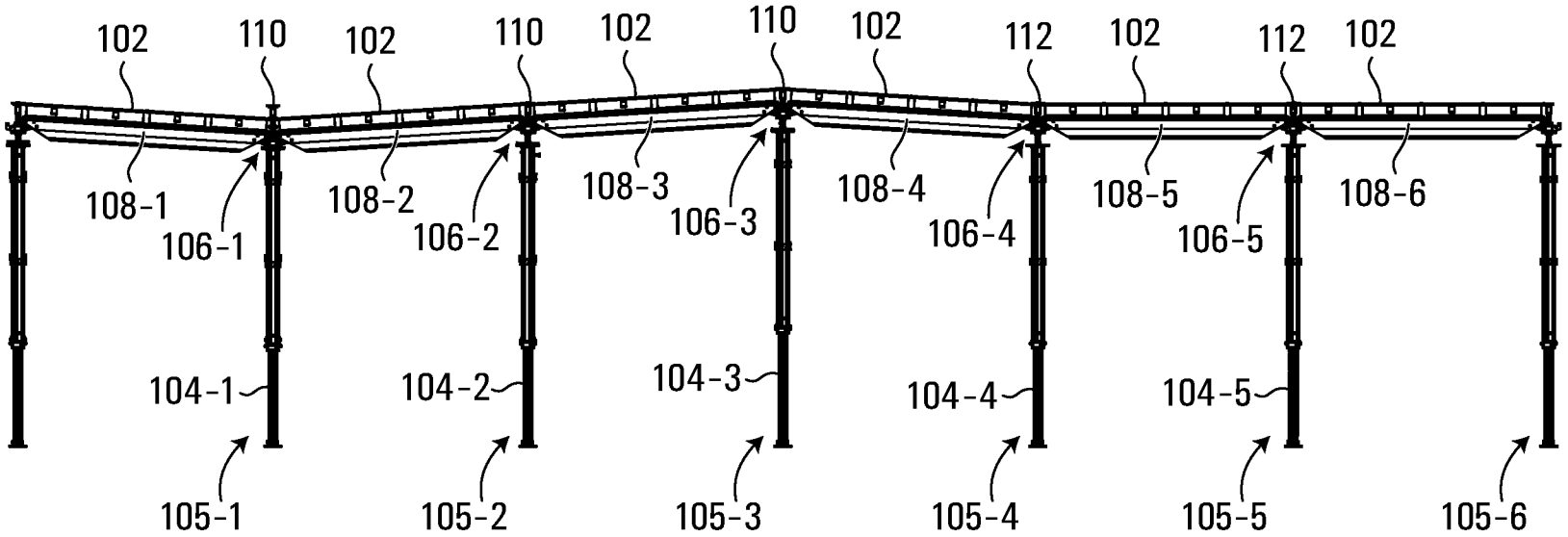
FIG. 1B is a side views of formwork system 100 in accordance with an example embodiment.

Reference is made to FIGS. 1A-1B, illustrating perspective and side views of a formwork system 100 for supporting one or more forming panels 102.

Forming panels 102 provide a flat surface to pour liquid concrete thereon. In one embodiment, a plywood panel is used to provide the flat surface. In one embodiment, forming panels 102 may be 2 feet wide and 6 feet long. However, other sizes are possible: for example, forming panels 102 may range from 1 foot to 6 feet in length or width. In addition, different sized forming panels 102 may be used with formwork system 100.

In one embodiment, each plywood panel of a forming panel 102 is supported by beams (not shown) extending along the edges of the panel. The plywood panel may also be supported by a series of beams spanning the length or width of the panel. The beams of a forming panel 102 may be made of a light material, such as aluminum, or an alloy.

Formwork system 100 also includes a plurality of supports 105 and beams 108. Each support 105 has base portion 104 and a support head 106 at an upper portion of support 105. Beams 108 are supported at each end by support head 106. In one embodiment, support head 106 is removably mounted on a vertically extending post.

One or more supports 105 of system 100 may also support a compensation-strip 110. Compensation-strips 110 may be used to fill gaps 112 between panels 102 that form around support heads 106.

In use, a first pair of supports 105 (for example, including a pair of support heads 106 and a pair of vertically extending posts) may be used to suspend a first beam 108. A second pair of supports 105 may be used to suspend a second beam 108 in a substantially parallel position to the first beam 108. One or more forming panels 102 may be supported on each of the first and second beams to form a suspended horizontal surface suitable for pouring concrete thereon. The horizontal surface formed by system 100 may have sections that are inclined and sections that are level.

Additional beams 108, supports 105, and forming panels 102 can be arranged side-by-side to form a larger suspended horizontal surface suitable for pouring concrete thereon.

As illustrated in FIG. 1B, formwork system 100 allows for forming leveled and inclined horizontal concrete surfaces. In addition, formwork system 100 may be used to form a single horizontal concrete surface that transitions between upward sloping and downward sloping. For example, as illustrated in FIG. 1B beam 108-1 and the panels associated therewith are sloping up relative to support head 106-1. Similarly, beam 108-2 and the panels associated therewith are sloping down from support head 106-2. Similarly, beam 108-3 and the panels associated therewith are sloping down from support head 106-3. Similarly, beam 108-4 and the panels associated therewith are sloping up relative to support head 106-4. Similarly, beam 108-5 and the panels associated therewith are level with support head 106-5. Beam 108-6 and the panels associated therewith also level.

The incline angle of a particular beam may be adjusted by adjusting the height of one of the supports 105 supporting that particular beam (for example, by adjusting the height of one of or both of support head 106 and vertically extending post 104 supporting support head 106). As illustrated in FIG. 1B, the heights of supports 105-1 to 105-6 are varied (or base portion 104-1 to 104-5, for example, using height adjustable vertically extending posts) to achieve the desired angle of each of beams 108-1 to 108-6.

In one embodiment, the maximum incline angle of a beam 108 and the forming panels 102 associated therewith is plus or minus 5 degrees relative to the horizontal.

Figure 1C:
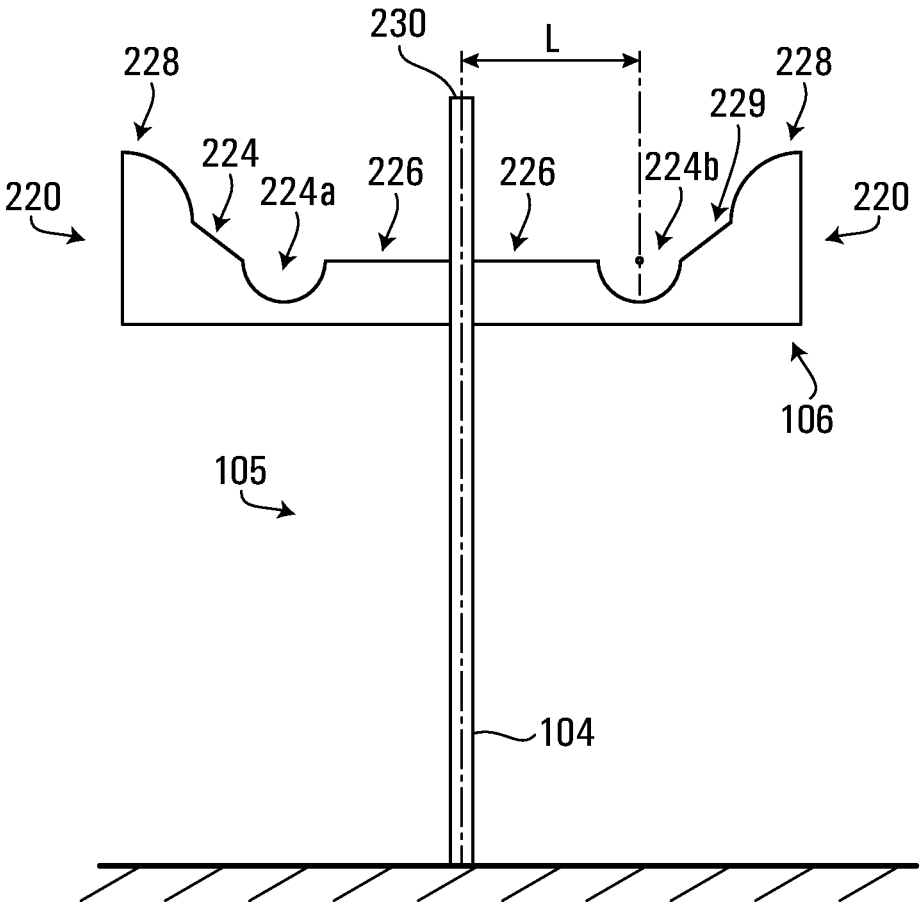
FIG. 1C is a side view of a support for use with the formwork system 100 in accordance with an example embodiment.

Reference is made to FIG. 1C illustrating an example support 105 for use formwork system 100 in accordance one embodiment. Support 105 has a support head 106 having support arms 220. Support head 106 and support arms 220 thereof are supported in an elevated position by base portion 104 of support 105. Beams 108 are supported at each end by support arms 220 of support head 106.

Support arms 220 may be lowered or raised to vary the slope of beams 108 supported by the support head 106. In one embodiment, support head 106 is mounted on a height-adjustable vertically extending post, and the height of support arms 220 is adjustable by adjusting the height of the vertically extending post. In one embodiment, support head 106 has support arms 220 that are height-adjustable independently from base portion 104.

As shown, support 105 has two support arms 220 positioned on opposite sides of support 105, but other embodiments are possible. For example, each support 105 may have four support arms 220.

Figure 2A:
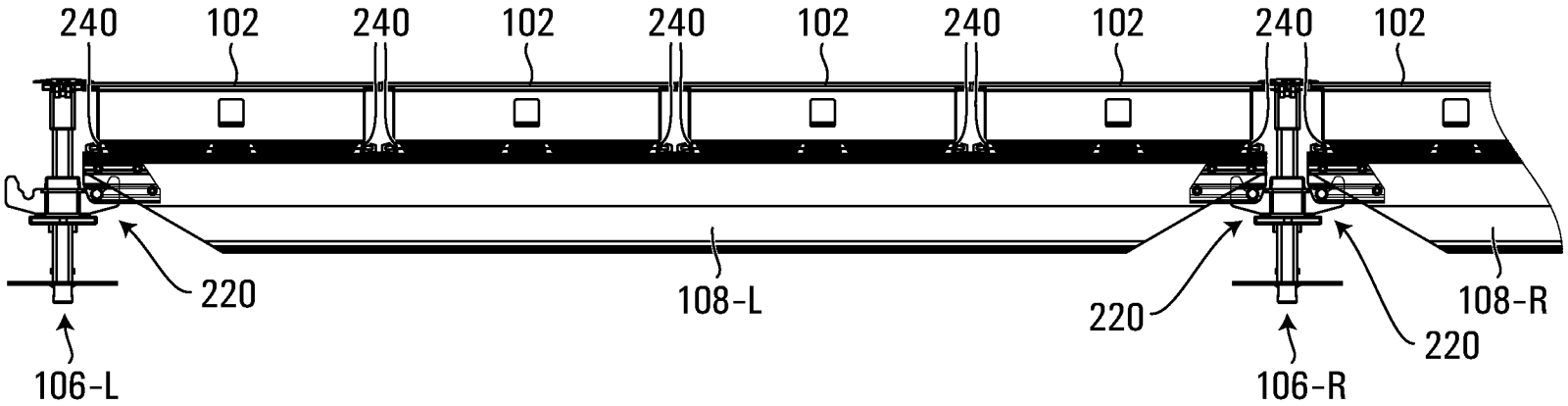
FIGS. 2A-2E are close-up side views of the formwork system 100.
Figure 2B:
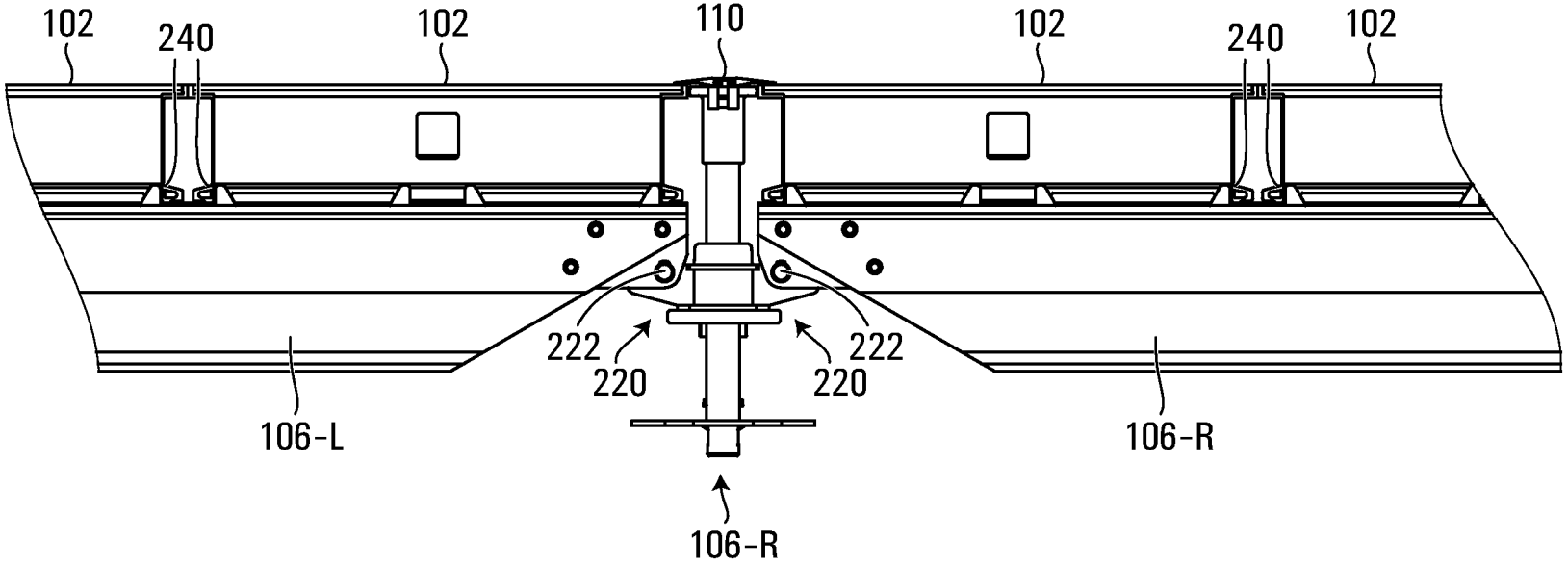
Figure 8A:
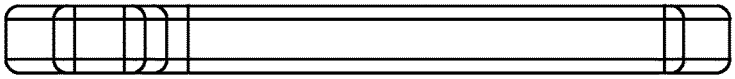
FIG. 8A is a side view of a release wedge for use with the support of FIG. 3A in accordance with an example embodiment.
Figure 8B:
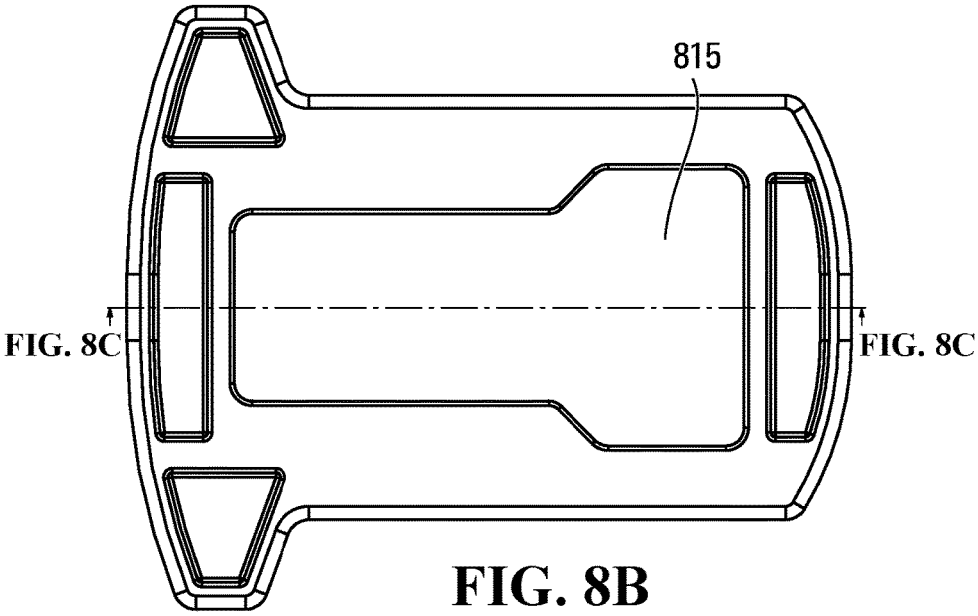
FIG. 8B is a top view of the release wedge element of FIG. 8A.
Figure 8D:
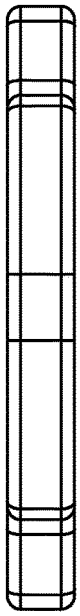
FIG. 8D is a second side view of the release wedge element of FIG. 8A.
Figure 8C:
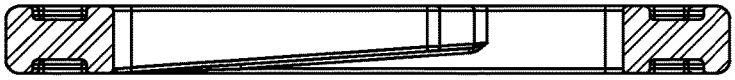
FIG. 8C is a cross-section view of the release wedge element of FIG. 8A.
Figure 8E:
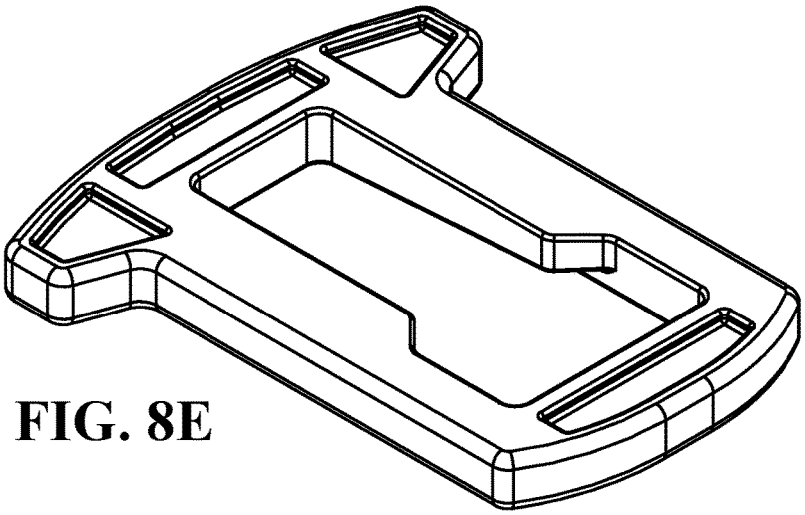
FIG. 8E is a perspective view of the release wedge element of FIG. 8A.
Figure 8F:
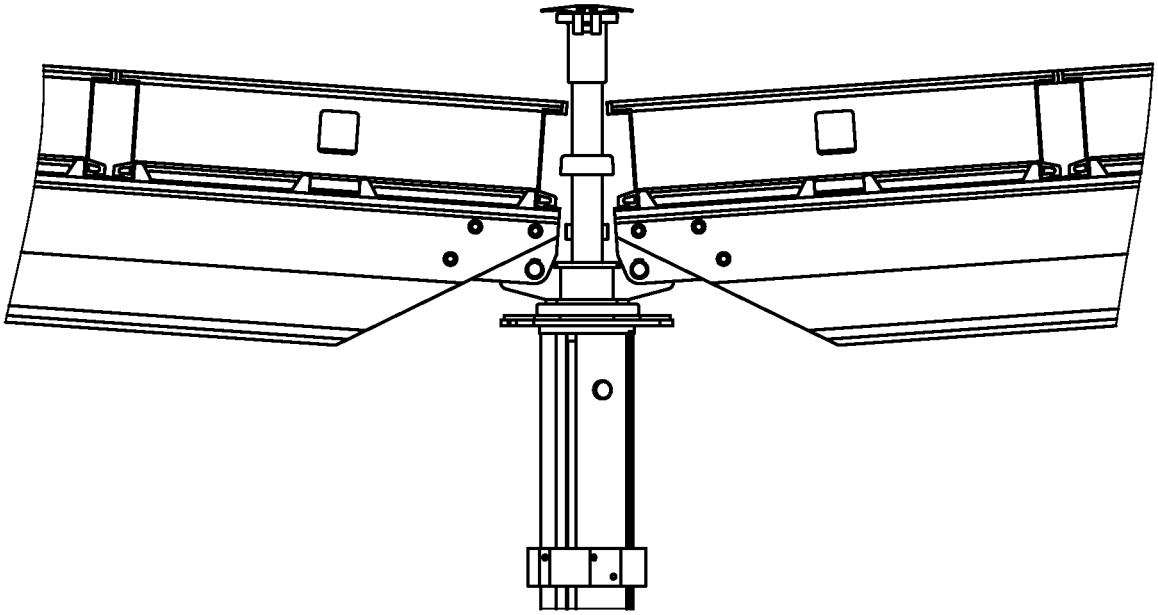
FIG. 8F is a close-up side view of the formwork system 100 in a second position in accordance with an example embodiment.
Figure 8G:
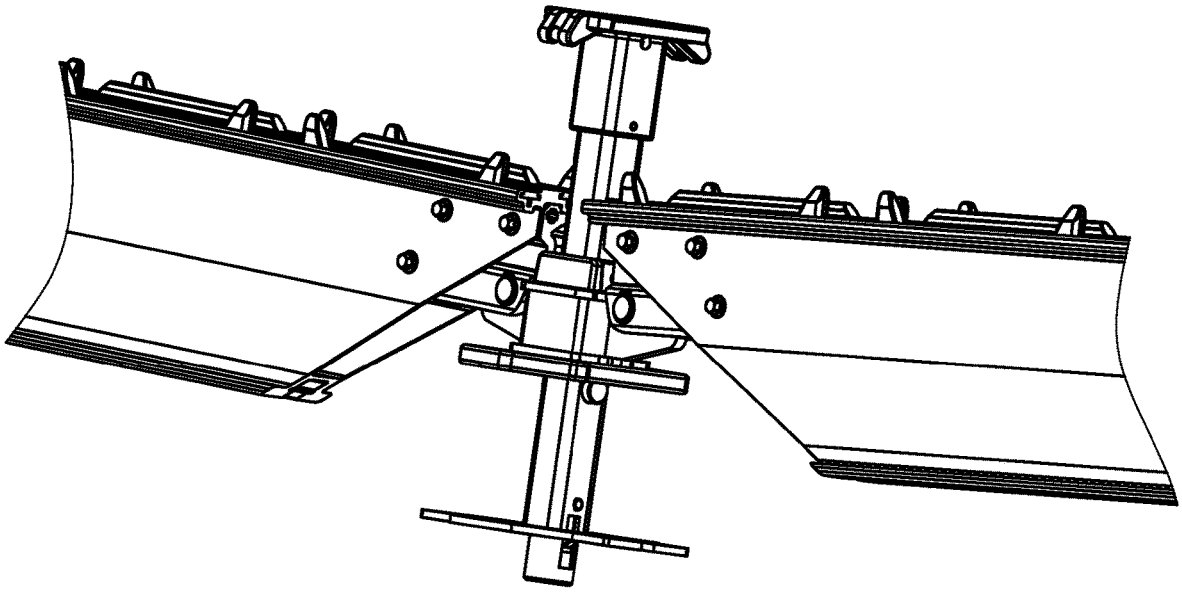
FIG. 8G is a close-up perspective view of the formwork system 100 in FIG. 8F.
Figure 8H:
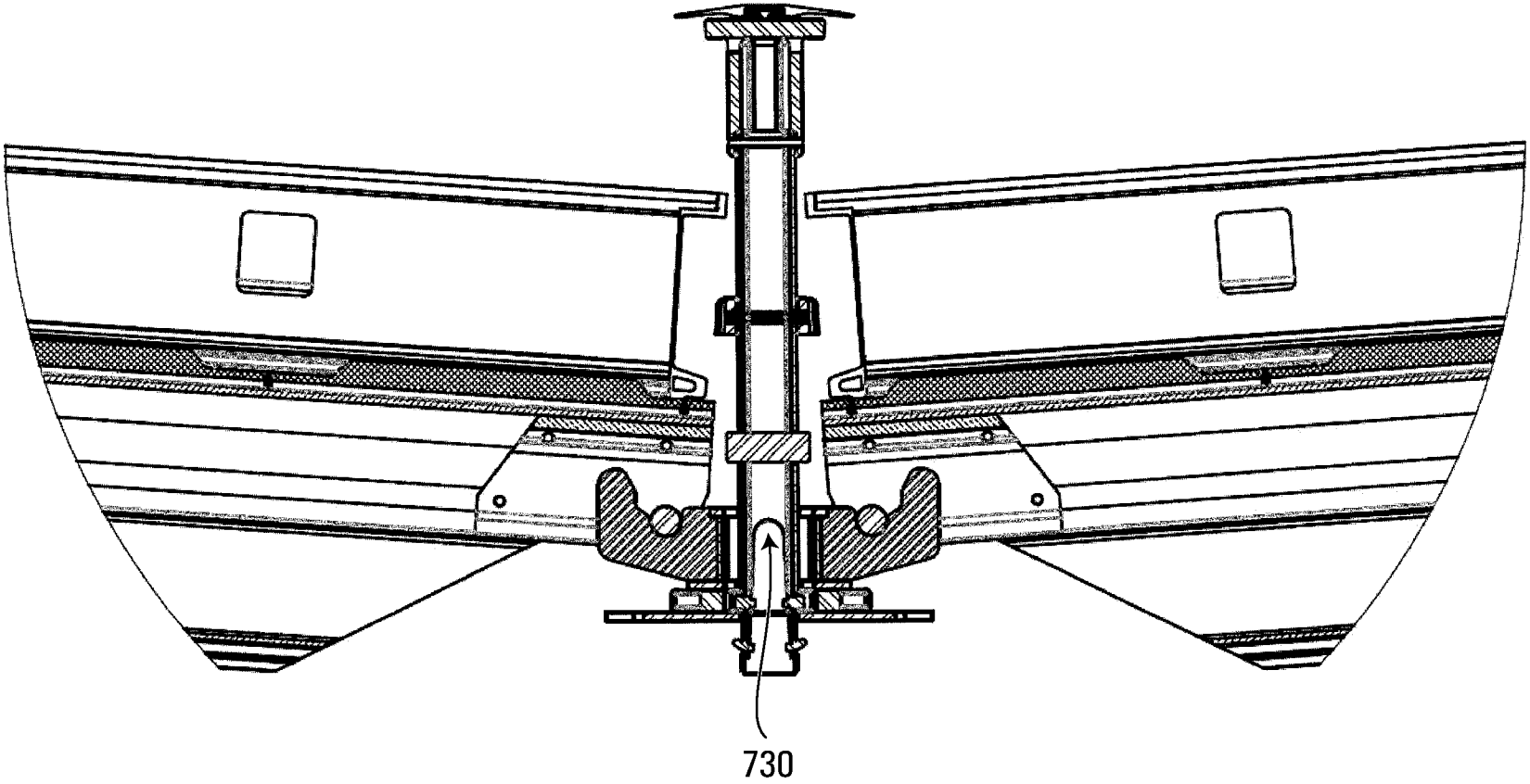
FIG. 8H is a cross-section view of the formwork system 100 in FIG. 8F.

Support arm 220 of support 105 includes two rounded socket 224*a*, 224*b* (individually and collectively socket(s) 224) each for receiving a transverse mounting pin (also referred to as mounting pin 222) of beam 108. In one embodiment, and as also depicted in FIGS. 2F and 8H, the interior wall of socket 224 defines a semi-circular groove (i.e. the circular sector defined by the interior wall of socket 224 has central angle of about 160°-200°). In one embodiment, socket 224 is positioned between a flat portion 226 of support arm 220 and an inclined portion 229 of support arm 220. The center of socket 224 is at a distance L from the center of support head 106.

In one embodiment, socket 224 is approximately 6 mm thick and has a diameter of approximately 21 mm. Notably, the dimensions of socket 224 substantially corresponds with the length and diameter of the mounting pin of beam 108 such that the mounting pin is rotatably retained within socket 224.

Support 105 also has a central upstanding member 230 at the center of support head 106. Central upstanding member 230 extends vertically upwards relative to support arms 220.

Figure 1D:
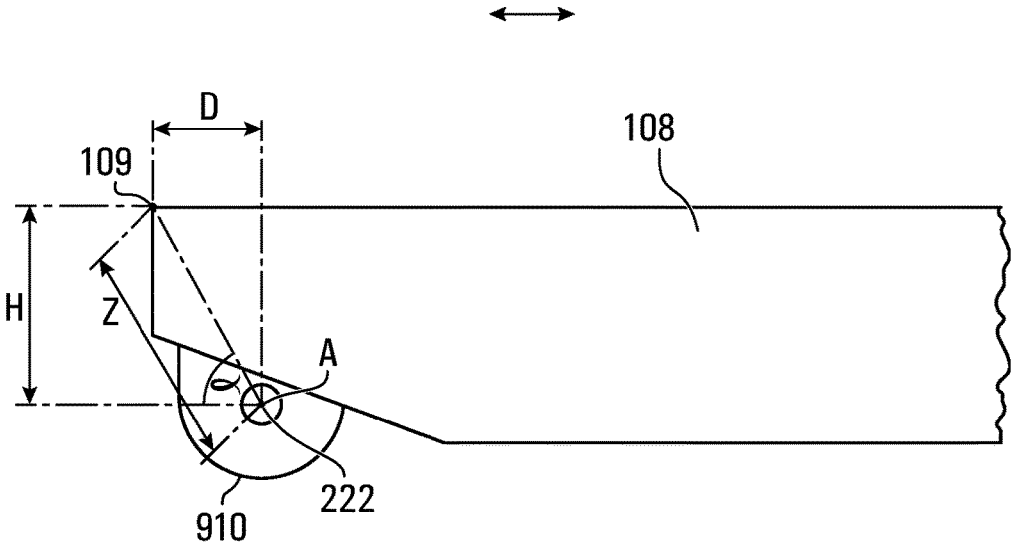
FIG. 1D is a side view of a beam for use with the formwork system 100 in accordance with an example embodiment.

Reference is made to FIG. 1D illustrating a partial side view of an example beam 108 for use with formwork system 100 in accordance one embodiment.

Figure 9A:
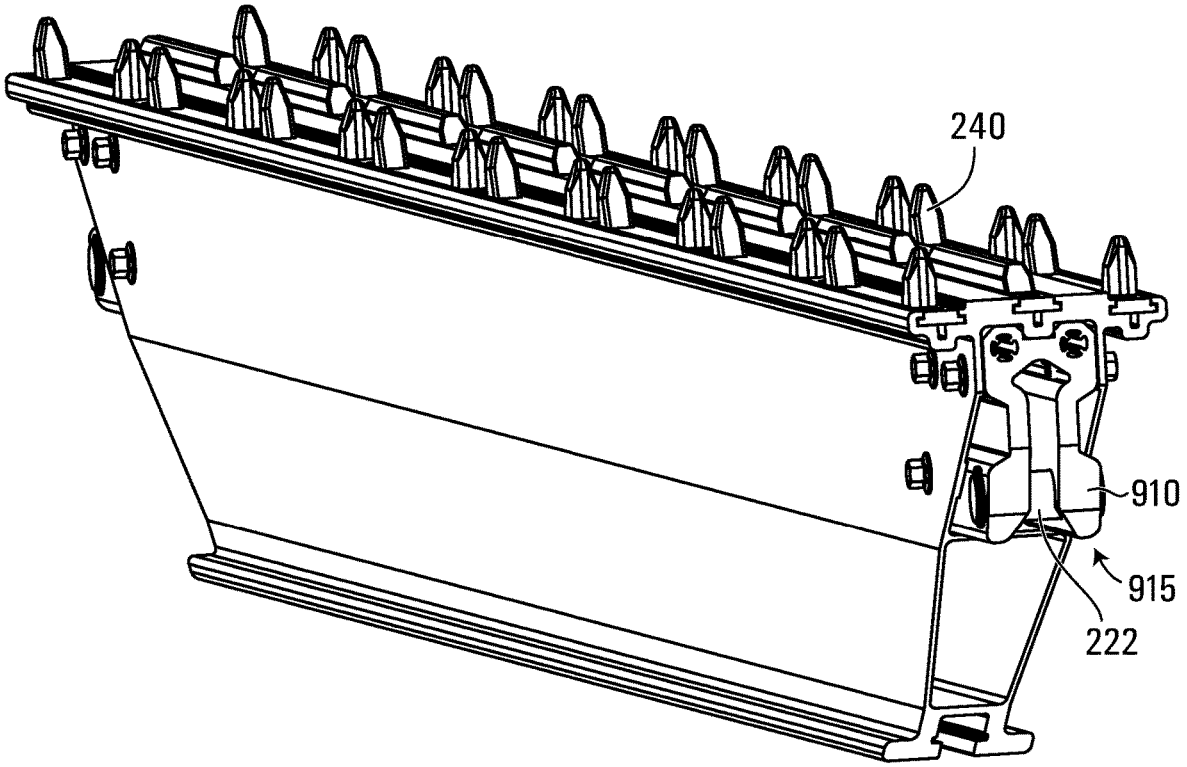
FIG. 9A is a top-perspective view of a beam for use with the formwork system 100 in accordance with an example embodiment.
Figure 9B:
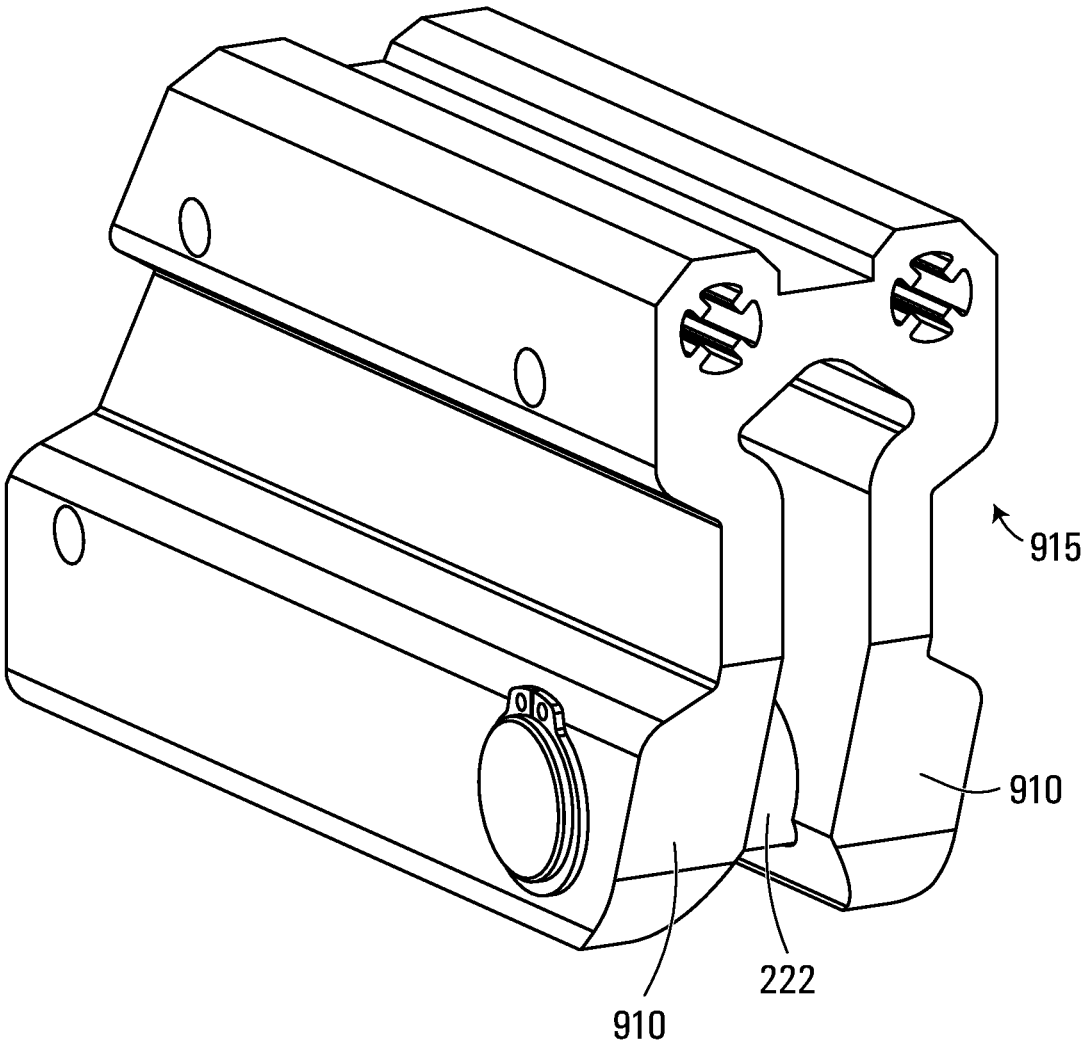
FIG. 9B is a top-perspective view of a saddle member for use with the beam of FIG. 9A.
Figure 9C:
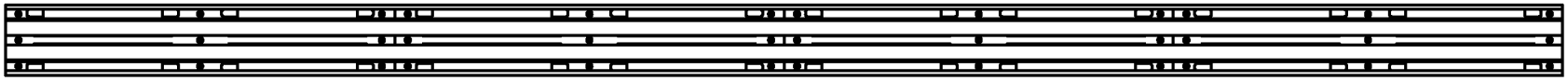
FIGS. 9C-9E are top, side, and bottom views of the beam of FIG. 9A.

In one embodiment, beam 108 has two side plates 910 attached proximate an end of the beam and extending away from the beam. In one embodiment, side plates 910 secure a mounting pin 222 in a position proximate the end of the beam (see FIGS. 9A-9B).

Mounting pin 222 is rotatable about an axis of rotation A, which coincides with the central longitudinal axis of mounting pin 222. Axis A is at a distance H from the upper surface of beam 108 and a distance D from near end of the beam 108. Upper surface of beam 108 and end of beam 108 meet at a leading edge 109, which is at a distance Z from axis A.

Figure 1E:
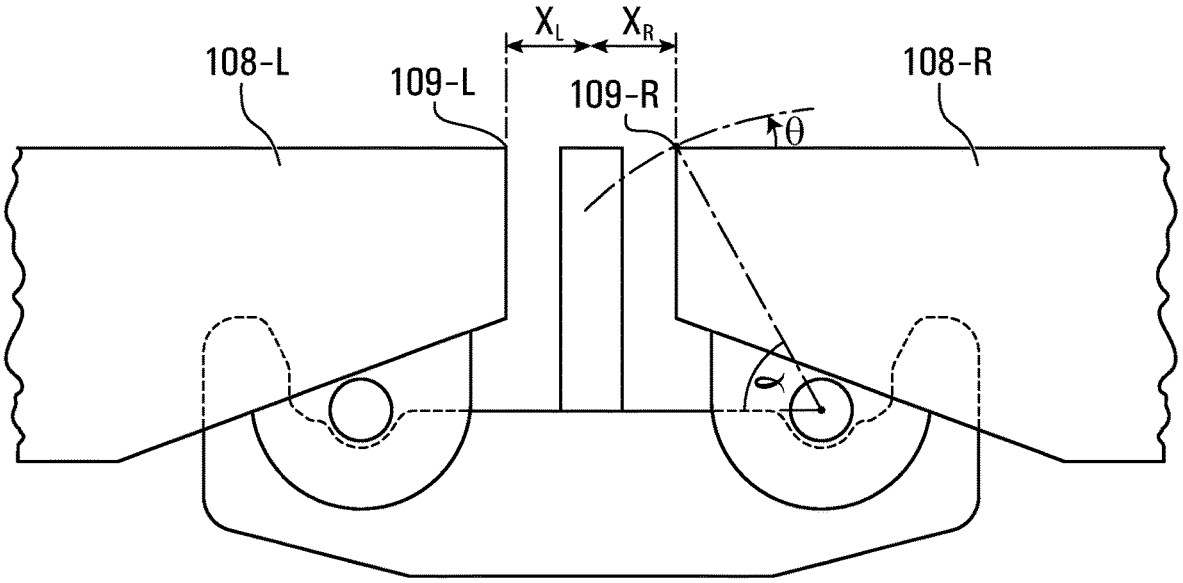
FIG. 1E is a close-up side view of the formwork system 100 in accordance with an example embodiment.

Reference is made to FIG. 1E illustrating a partial side view of support head 106 supporting beams 108 in accordance with one embodiment.

In use, mounting pin 222 of a support beam 108 may be retained in and supported by socket 224 of support arm 220 to suspend beam 108. This, in turn positions beam 108 relative to support head 106, and upstanding member 230. When mounting pin 222 is retained by socket 224, axis A will be positioned at the center of socket 224 and will be at a distance L from the center of support head 106.

As the incline angle of beam 108 is changed, mounting pin 222 will rotate about axis A within socket 224, and will remain retained within socket 224.

Conveniently, the shape of mounting pin 222 and socket 224 are complementary, so that mounting pin 222 may be rotated about axis A, allowing beam 108 to be pivoted about this axis. As socket 224 is complementary in size and shape to mounting pin 222, the axis of rotation A of mounting pin 222 does not materially move or change within socket 224—axis A remains substantially invariant within socket 224. Thus, with support arm 220 stationary, axis A does not change for different angular inclinations of beam 108.

In an embodiment, as depicted in FIGS. 1E and 2A-2F, two beams 108-L and 108-R are supported by a single support head 106. The location of mounting pin 222 of each beam 108-L and 108-R will be fixed relative to the other as a result of the relative placement of the two sockets 224 in support arm 220. Conveniently, this remains the case even as beams 108-L and 108-R are pivoted relative to their horizontal orientation. The size of gaps formed between the end of beams 108-L and upstanding member 230, and between the end of beam 108-R and upstanding member 230 are thus predictable, and a function of the angle of inclination of each beam.

As shown in FIG. 1E, when beams 108-L and 108-R are supported by sockets 224 of support arms 220, the horizontal distance between leading edge 109-L of beam 108-L and the center of support head 106 is $X_L$, the horizontal distance between leading edge 109-R of beam 108-R and the center of support head 106 is $X_R$, and the distance between leading edge 109-L and leading edge 109-R is the sum of $X_L$ and $X_R$.

As beam 108 pivots about axis A, the horizontal distance between its leading edge 109 and the center of support head 106 will also change. Notably, as beam 108 rotates about axis A, the leading edge 109 of beam 108 moves along the arc of a circle of radius Z having its center at axis A. Therefore, the horizontal distance X between leading edge 109 of beam 108 and center of support head 106 may be expressed as a function of incline angle θ of beam 108 relative to the horizontal with the function:

$$x = L - \sqrt{H^2 + D^2} \times \cos\left(\tan^{-1}\left(\frac{H}{D}\right) - \theta\right).$$

Figure 2C:
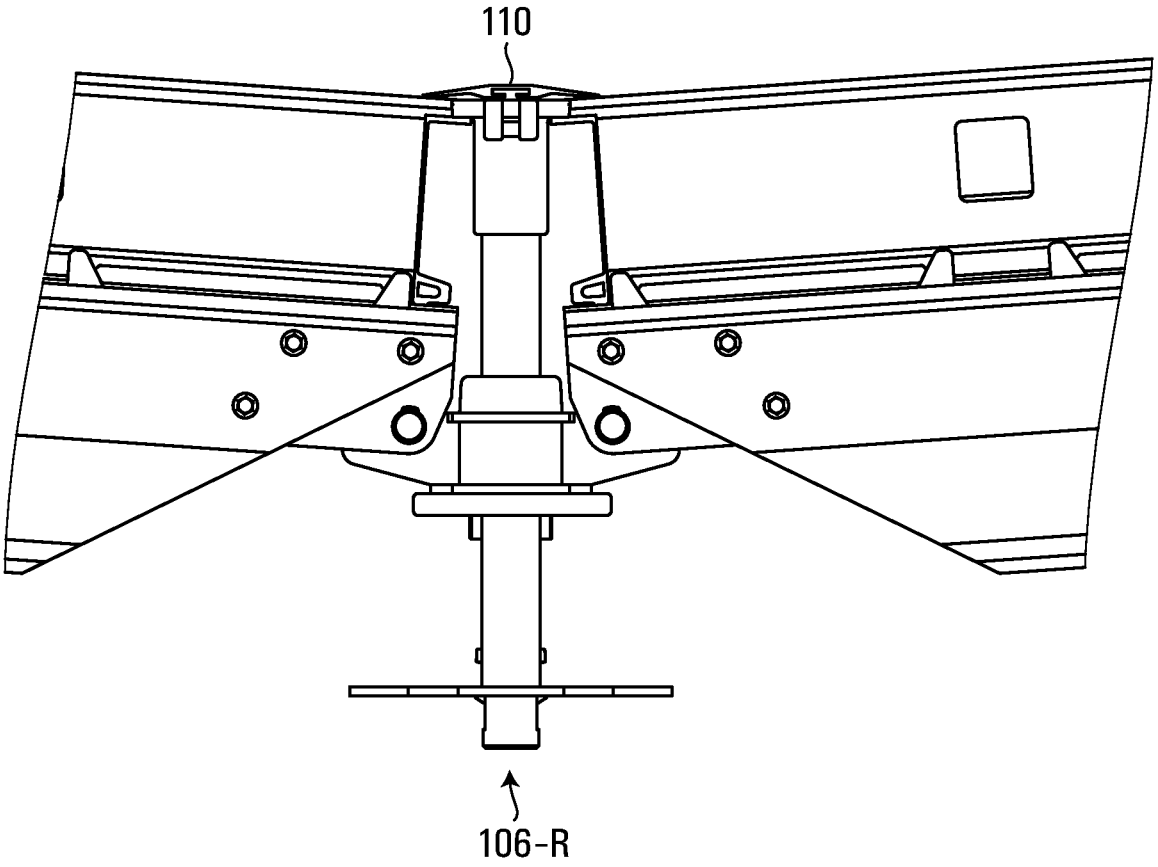
Figure 2D:
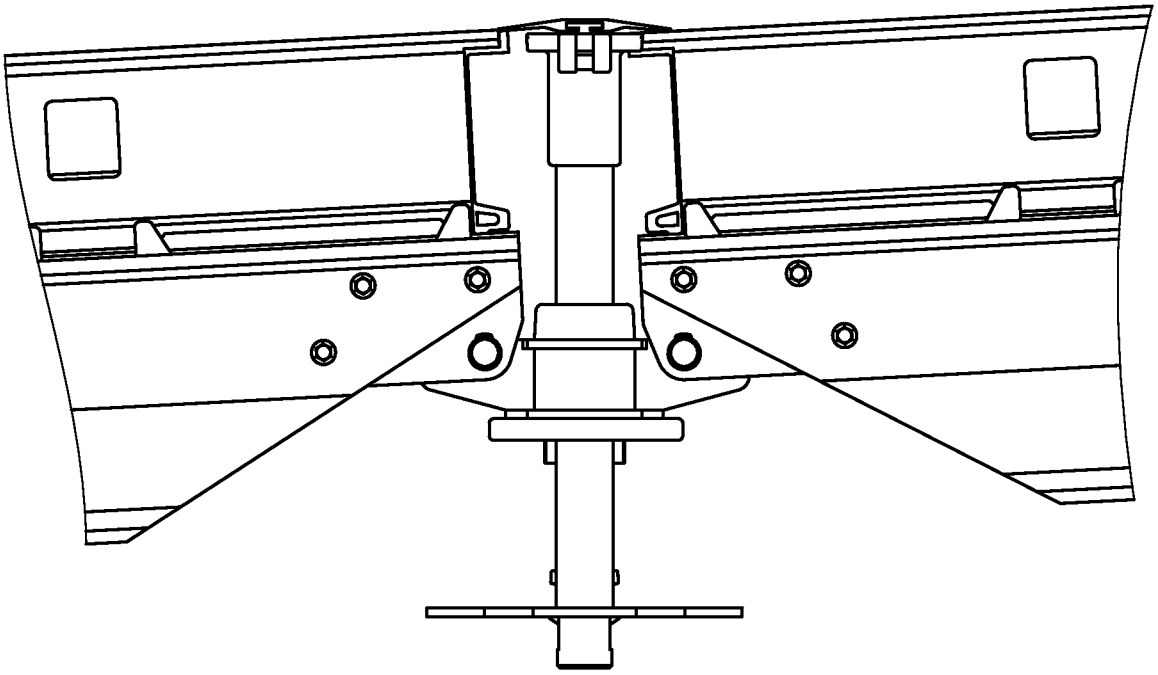
Figure 2E:
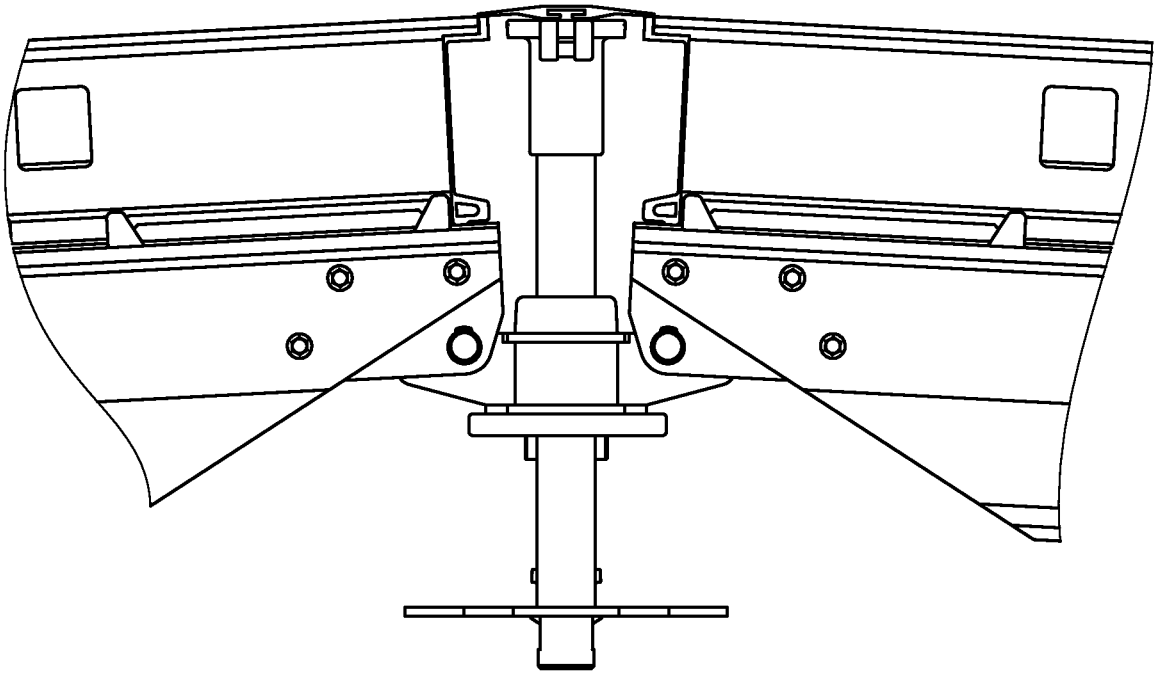
Figure 2F:
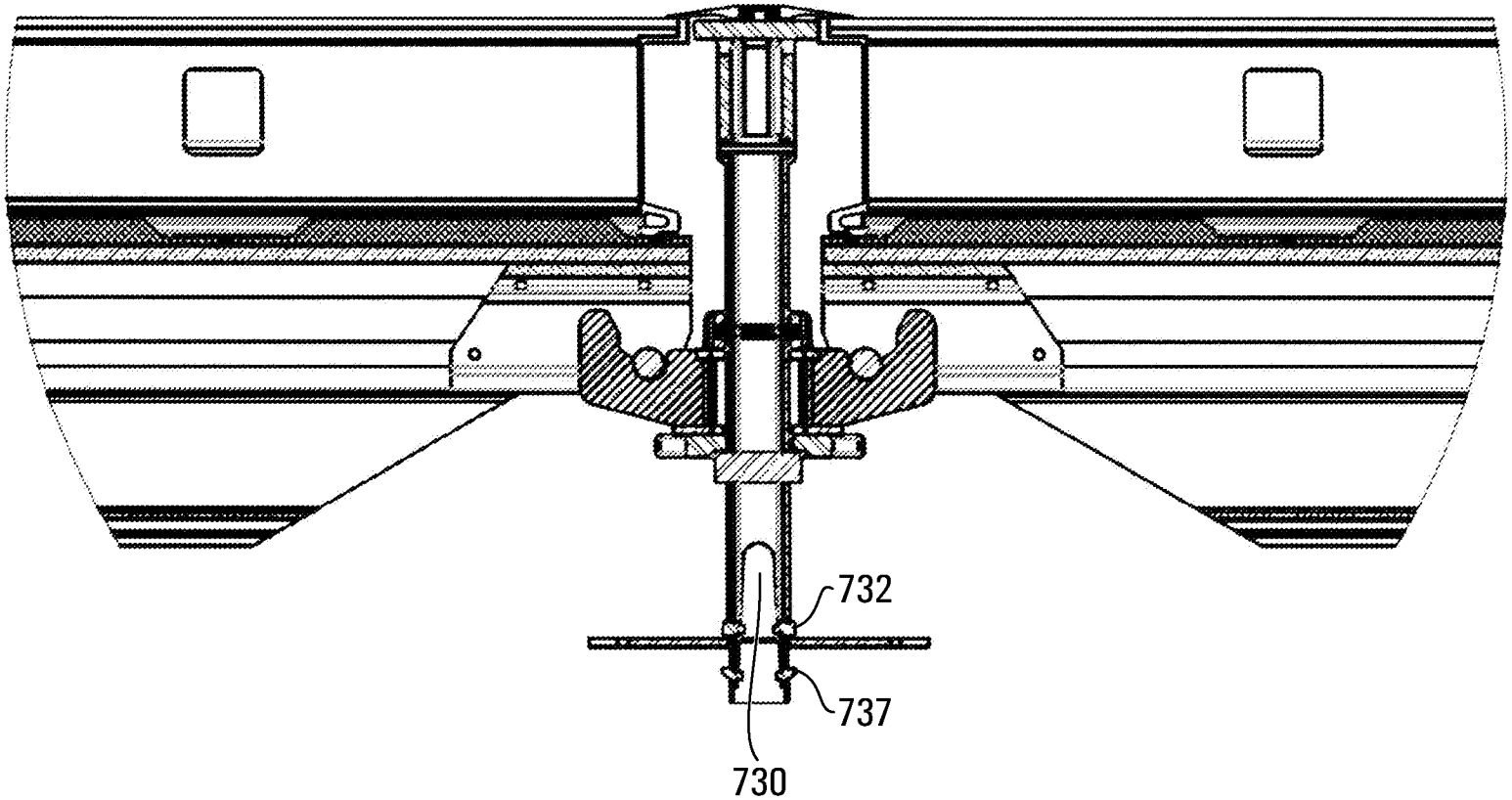
FIG. 2F is a cross-section close-up side view of the formwork system 100.
Figure 3A:
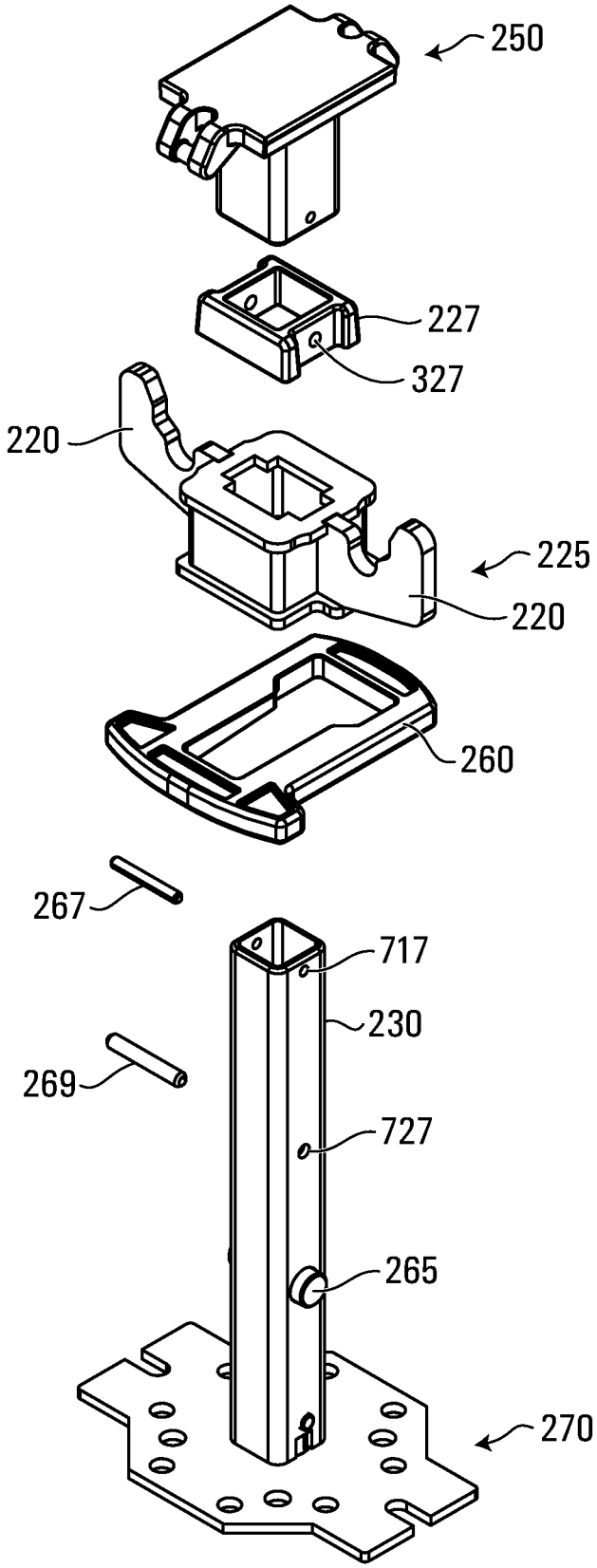
FIG. 3A is an exploded view of a support for use with the formwork system 100 in accordance with an example embodiment.
Figure 4D:
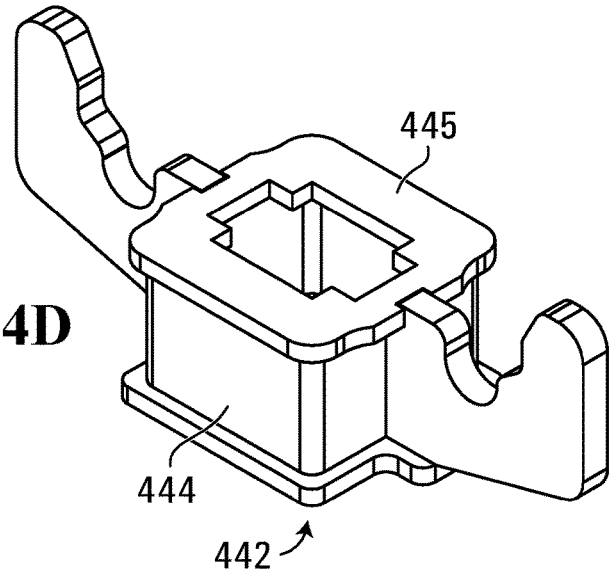
FIG. 4D is a top-perspective view of the support head of FIG. 4A.
Figure 4A:
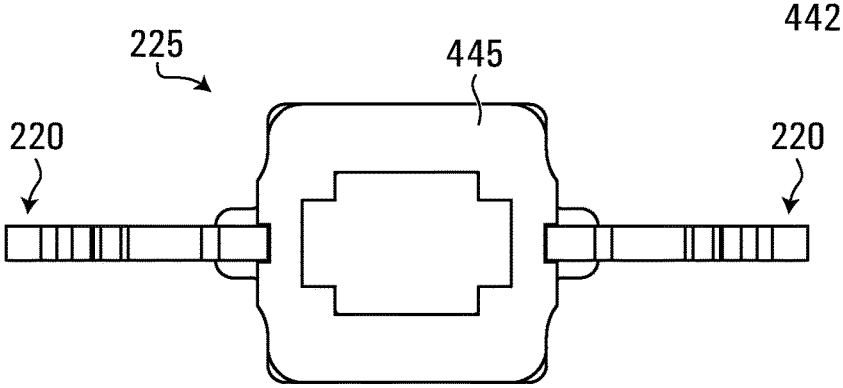
FIG. 4A is a top view of a support head for use with the support of FIG. 3A in accordance with an example embodiment.
Figure 4B:
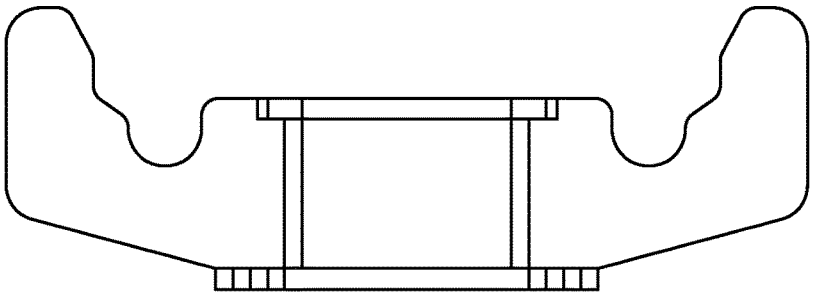
FIG. 4B is a side view of the support head of FIG. 4A.
Figure 4C:
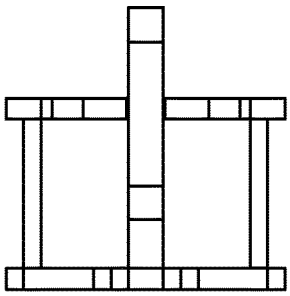
FIG. 4C is a second side view of the support head of FIG. 4A.

The gap between adjacent forming panels 102 is maximized when adjacent beams 108 are both sloping down relative to support head 106 (as shown in FIG. 2E), and the gap between adjacent forming panels 102 is minimized when adjacent beams 108 are both sloping up relative to support head 106 (as shown in FIG. 2C). The maximum and minimum gap between forming panels 102 supported by beams 108-L and 108-R may be approximated as a function of the dimensions of beam 108, the distance between socket 224 and center of support head 106, and the maximum incline and decline angle of beams 108. A single type of compensation-strip 110 may thus be used with formworks 110.

In one exemplary embodiment, the upper surface of beam 108 is at a distance of about 100 mm from the center of mounting pin 222, the end of upper beam 108 is at a distance of about 30 mm from the center of mounting pin 222, and the center of socket 224 is about 100 mm from the center of support head 106 (i.e. H=100 mm, D=30 mm, L=100 mm). The maximum incline angle of a beam 108 and the forming panels 102 associated therewith may be approximately plus or minus 5 degrees relative to the horizontal. The maximum and minimum gap between forming panels 102 in the exemplary embodiment are thus approximately 125 mm and 93 mm respectively, and a compensation-strip 110 of approximately 140 mm may be used to fill gaps 112 between panels 102.

Reference is made to FIGS. 2A, 2B, and 2F, illustrating beams 108-L, 108-R (generally referred to as "beams 108") and support heads 106-L, 106-R (generally referred to as "support heads 106"). Support heads 106 are each supported in an elevated position, for example by a vertically extending post (not shown).

Beam 108-L is supported by support arms 220 of support head 106-L at one end and by support arms 220 of support head 106-R at a second end in a level position. Beam 108-R is supported by support arms 220 of support head 106-R at one end and by support arms 220 of a second support head (not shown) at a second end (not shown) in a level position. When beam 108 is supported by support arm 220, the mounting pin 222 of beam 108 is supported by socket 224 of support arm 220.

Each beam 108 has protrusions 240 extending upwardly from an upper surface of the beam. Each protrusion 240 is configured to engage the lower surface of a forming panel 102 to prevent lateral movement of the forming panel 102 along beam 108.

Reference is made to FIG. 2C, illustrating beams 108-L, 108-R and support head 106-R. In FIG. 2C, support arm 220 of support head 106-R has been moved down vertically relative to its position in FIGS. 2A, 2B, and 2F; thus, both beams 108-L, 108-R are sloping up relative to support head 106-R. The beams 108 now create a 'valley'.

Support arm 220 of support head 106 may be moved vertically downwards by adjusting the height of a vertically extending post upon which support head 106 is mounted. Alternatively, support arm 220 may be vertically movable relative to central upstanding member 230.

As the height of support head 106-R decreases, the height of mounting pins 222 supported thereon also decreases. Since the height of support arms (not shown) supporting the other ends of beams 108 remain constant, the decrease in the height of support head 106-R causes mounting pin 222 to rotate within the sockets 224 of support arm 220. Since beams 108 have a fixed length, the change in height of mounting pin 222 will result in a lateral shift of the opposite end of beam 108. Further, any forming panels 102 resting on beam 108 which are laterally secured by protrusions 240 will move laterally along with beam 108.

In formwork system 100, such lateral shift may be accommodated by slack in the coupling between support heads 106 and vertically extending posts (not shown). For example, support heads 106 may be loosely coupled to vertically extending posts (not shown) such that a support head 106 may have a range of lateral movement of about plus or minus 4 mm relative to its connected vertically extending post. Further, the vertically extending post (not shown) may shift laterally to accommodate the lateral shift of beam 108.

In one embodiment, beam 108 is approximately 2.4 m long and a decrease in the height of a support head 220 at one end of the beam 108 by approximately 220 mm will result in a lateral shift of only about 9 mm at the opposing end of beam 108. Further, the decrease in height of support head 220 will cause beam 108 to incline up relative to the support head 106 at an angle of about 5 degrees.

As shown in FIG. 2C, the gap between forming panels 102 supported by beam 108-L and forming panels 102 supported by beam 108-R is relatively smaller when beams 108 are sloping up relative to support head 106-R compared to when beams 108 are level (FIGS. 2A, 2B, and 2F).

Reference is made to FIG. 2E illustrating beams 108-L, 108-R and support head 106-R. In FIG. 2E, support arm 220 of support head 106-R has been moved vertically upwards relative to its position in FIGS. 2A, 2B, and 2F; thus, both beams 108-L, 108-R are sloping down relative to support head 106-R. The beams 108 now create a 'peak'.

As the height of support head 106-R increases, the height of mounting pins 222 supported thereon also increases. Since the height of support arms (not shown) supporting the other ends of beams 108 remain constant, the increase in the height of support head 106-R causes mounting pin 222 to rotate within the sockets 224 of support arm 220. Since beams 108 have a fixed length, the change in height of mounting pin 222 will result in a lateral shift of the opposite end of beam 108. Further, any forming panels 102 resting on beam 108 which are laterally secured by protrusions 240 will move laterally along with beam 108. As described above, such lateral shift may be accommodated by slack in the coupling between support heads 106 and vertically extending posts (not shown), or by lateral shifting by the vertically extending post (not shown).

In an embodiment, beam 108 is approximately 2.4 m long and an increase in the height of a support head 220 at one end of the beam 108 by approximately 220 mm will result in a lateral shift of only about 9 mm at the opposing end of beam 108. Further, the increase in height of support head 220 will cause beam 108 to incline down relative to the support head 106 at an angle of about 5 degrees.

As shown in FIG. 2E, the gap between forming panels 102 supported by beam 108-L and forming panels 102 supported by beam 108-R is relatively larger when beams 108 are sloping down relative to support head 106-R compared to when beams 108 are level (FIGS. 2A, 2B, and 2F).

Reference is made to FIG. 2D illustrating beams 108-L, 108-R and support head 106-R. In FIG. 2D, support arm 220 of support head 106-R is in the same vertical position as in FIG. 2E, but the second support head (not shown) supporting beam 108-R has been moved vertically upwards relative to its position in FIG. 2E. Thus, beam 108-L is sloping down from support head 106-R whereas beam 108-R is sloping up relative to support head 106-R. The beams 108 now create a 'ramp'.

The increase in the height of the second support arm (not shown) causes mounting pin 222 of beam 108-R resting in socket 224 of support head 106-R to rotate. As the height of second support arm (not shown) increases, the height of the mounting pin (not shown) supported thereon also increases. Since beams 108 have a fixed length, the change in height of the mounting pin (not shown) supported by the second support arm (not shown) will induce a lateral shift of mounting pin 222 supported on support head 106-R towards the second support arm (not shown). Support head 106-R may shift relative to the vertically extending post (not shown) on which it is mounted. Alternatively or additionally, vertically extending post (not shown) may shift towards the second support arm (not shown) and thus shift support head 106-R towards second support arm (not shown). Consequential to any lateral shift by support head 106-R, mounting pin 222 of beam 108-L will also shift. The shift of beam 108-L may similarly be accommodated by slack in the couplings between support head (not shown) supporting opposing end of beam 108-L and its corresponding vertically extending post (not shown). Alternatively or additionally, the shift of beam 108-L may be accommodated by lateral shifting by the vertically extending posts (not shown) at either ends of beam 108-L.

In addition, the gap between forming panels 102 supported by beam 108-L and forming panels 102 supported by beam 108-R is relatively smaller in FIG. 2D compared to in FIG. 2E.

As described above in reference to FIGS. 2C, 2E and 2D, a change in the height of a support arm 220 supporting a mounting pin 222 of a beam 108 results in lateral movement of beam 108. Further, any forming panels resting on beam 108 which are laterally secured by protrusions 240 will move laterally along with beam 108. However, each mounting pin 222 of a beam 108 is rotatably retained within a corresponding socket 224. Thus, in formworks system 100, any lateral movement of beam 108 may cause marginal lateral movement of support head 106 relative to its corresponding vertically extending post. Alternatively or additionally, lateral movement of beam 108 may cause lateral shifting of vertically extending posts of formworks system 100.

Reference is now made to FIGS. 3A-3E, showing an example embodiment of support head 106 in isolation. As will be explained in greater detail below, support head 106 has a support arm block 225 including support arm(s) 220, a base portion 270 for mounting support head 106 on a vertically extending post (not shown), a stopper 227 providing an abutment surface for saddle member 915 (shown in FIGS. 9A and 9B), a release wedge 260 for allowing support head 106 to function as a 'drop-head' (as will be explained later), and an upper support 250 for supporting a compensation-strip 110. In one embodiment, support head 106 extends by approximately 500 mm from the top of upper support 250 to the bottom of base portion 270.

Stopper 227 is hollow and is larger in size than upstanding member 230, such that stopper 227 maybe inserted over central upstanding member 230. In one embodiment, stopper 227 is approximately 70 mm long, 58 mm wide and 25 mm tall. In contrast, central upstanding member 230 is smaller in size (for example, 40 mm×40 mm in size). In one embodiment, stopper 227 is made of a metallic material, such as aluminum or steel.

In one embodiment, stopper 227 includes through-holes 327 and central upstanding member 230 includes corresponding through-hole 727. Through-hole 327 and through-hole 727 may be aligned when stopper 227 is inserted over central upstanding member 230. To removably secure the two members to one another, pin 269 may be inserted into through-hole 327 of stopper 227 and into corresponding through-hole 727 of central upstanding member 230. In use, stopper 227 provides an abutment surface for saddle member 915 (shown in FIGS. 9A and 9B). In one embodiment, that when beam 108 supported on support head 106 is incline up relative to support head 106 by an angle of about 5 degrees above the horizontal, saddle member 915 of beam 108 abuts stopper 727 and prevents further upward inclination of beam 108.

One example embodiment of support arm block 225 of support head 106 is illustrated in isolation in FIGS. 4A-4D. Support arm block 225 has a central block 445, formed by an upper base plate 440 and a lower base plate 442 separated by a vertical plates 444. Each of upper base plate 440 and lower base plate 442 has a void in the center thereof. Support arm block 225 receives central upstanding member 230 through the voids in upper and lower base plates 440, 442 and may be vertically moveable relative to central upstanding member 230 (See FIGS. 3A-3E). In one embodiment, each of upper and lower base plates 440, 442 is approximately 80 mm×80 mm in size. In one embodiment, each of the voids of upper and lower base plates 440, 442 is rectangular in shape and is approximately 60 mm×41 mm with indents of approximately 10 mm×10 mm at each corner of the rectangular void. Further, in one embodiment, central upstanding member 230 is marginally narrower than the width voids of upper and lower base plates 440, 442 (for example, 40 mm×40 mm in size), such that support arm block 225 can move vertically and laterally relative to central upstanding member 230.

In one embodiment, the plates of support arm block 225 are made of a metallic material, such as aluminum or steel. The plates may be secured to one another by welding.

In one embodiment, support arm block 225 includes two support arms 220, mounted at opposing sides of support arm block 225. In one embodiment, the distance between the two support arms 220 is approximately 200 mm.

Each support arm 220 may be a plate 420. Plate 420 provide socket 224 upon which mounting pin 222 of beam 108 may be supported.

Plates 420 may be made of a metallic material, such as aluminum or steel. Plates 420 may interlock with central block 445 of support arm block 225. In one embodiment, support arms 220 are welded to central block 445.

Figure 5A:
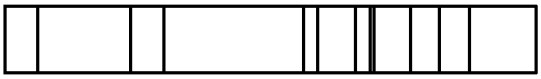
FIG. 5A is a top view of a plate for use with the support head of FIG. 4A in accordance with an example embodiment.
Figure 5B:
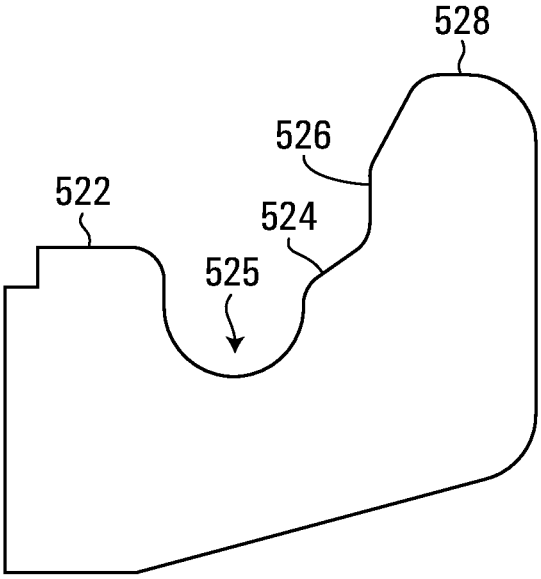
FIG. 5B is a side view of the plate of FIG. 5A.
Figure 5C:
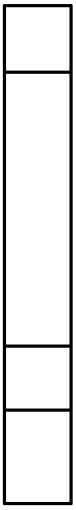
FIG. 5C is a second side view of the plate of FIG. 5A.
Figure 6A:
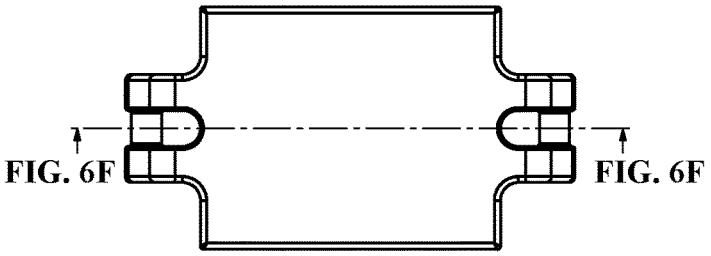
FIG. 6A is a top view of a support element for use with the support of FIG. 3A in accordance with an example embodiment.
Figure 6D:
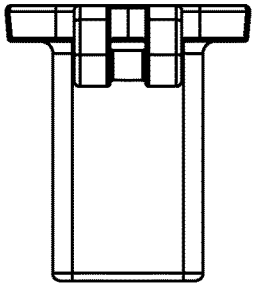
FIG. 6D is a second side view of the support element of FIG. 6A.
Figure 6B:
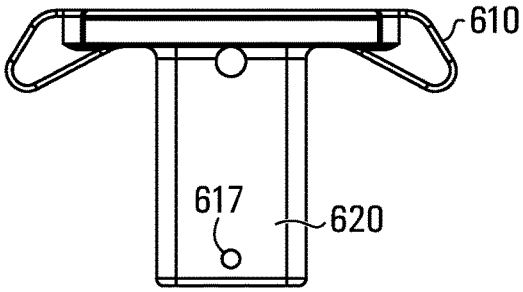
FIG. 6B is a side view of the support element of FIG. 6A.
Figure 6E:
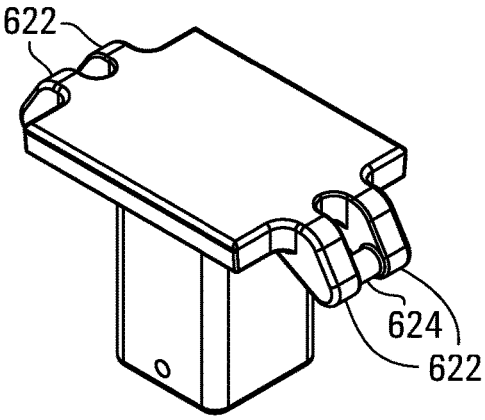
FIG. 6E is a top-perspective view of the support element of FIG. 6A.
Figure 6C:
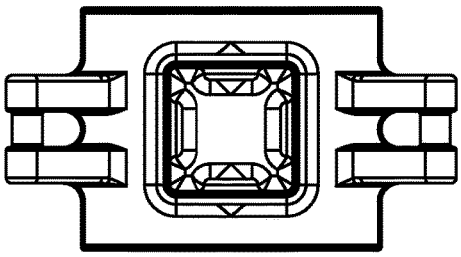
FIG. 6C is a bottom view of the support element of FIG. 6A.
Figure 6F:
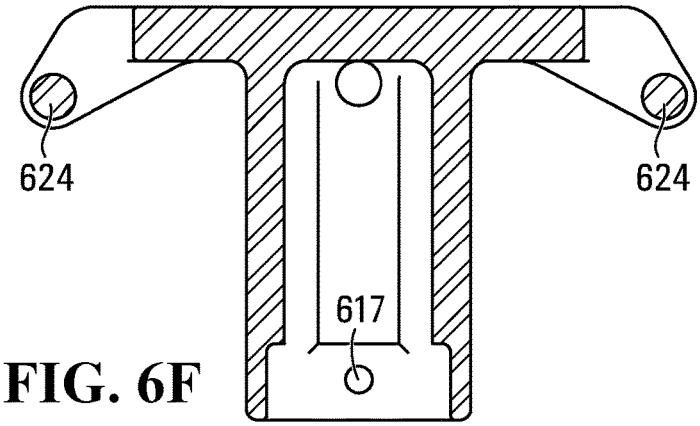
FIG. 6F is a cross-section side view of the support element of FIG. 6A.

One example embodiment of a plate 420 of support arm 220 of support arm block 225 is illustrated in isolation in FIGS. 5A-5C. Notably, as shown, each side plate 420 has a flat portion 522 which extends away from central block 445, a rounded portion 525 which extends away from flat portion 522, an inclined portion 524 which extends up and away from rounded portion 525, and a vertical portion 526 which extends up from inclined portion 524. Rounded portion 525 defines socket 224 of support arm 230 and is shaped and sized to receive mounting pin 222 of beams 108.

In one embodiment, rounded portion 525 is semi-circular, has a diameter of about 21 mm and sweeps out an arc of about 180 degrees. Notably, the diameter of rounded portion 525 may be marginally larger than the diameter of the mounting pin 222 supported therein. For example, the diameter of rounded portion 525 may be about 1 mm larger than the diameter of its corresponding mounting pin 222.

Rounded portion 525 is displaced from the central block 445 by flat portion 522 to provide beam 108 with clearance to rotate about mounting pin 222. In one embodiment, flat portion 522 may extend 25 to 35 mm away from central block 445.

Inclined portion 524 may be helpful in guiding mounting pin 222 into rounded portion 525. In one embodiment, inclined portion 524 extends up and away from the top of rounded portion 525 by about 10 mm to 20 mm.

In one embodiment, plate 420 is approximately 6 mm thick.

Vertical portion 526 may be helpful in preventing mounting pin 222 from rolling out of support arm 220 when only one end of beam 108 is supported, and thus also prevents beam 108 from falling. In one embodiment, vertical portion 526 extends up by 10 to 20 mm from the top of inclined portion 524.

In one embodiment, each plate 420 also has a tapered end 528 extending upwardly from vertical portion 526. Tapered end 528 may have a tapered slope extending from vertical portion 526, which may help direct mounting pin 222 towards rounded portion 525 of side plate 420. Further, in one embodiment, the outer edge of tapered end 528 may be curved to minimize sharp edges and reduce the likelihood of injury to a worker.

In some embodiments, tapered end 528 has a width ranging from 20 to 30 mm and a height ranging from 15 to 22 mm.

An example embodiment of upper support 250 for supporting a compensation-strip 110 is shown in isolation in FIGS. 6A-6F. Upper support 250 is mounted at the top of support head 106 such that when compensation-strip 110 is supported on upper support 250, compensation-strip 110 is level with forming panels 102 adjacent to the compensation-strip 110.

In one embodiment, as shown in FIGS. 6B, 6D, 6E and 6F, upper support 250 is T-shaped, having an upper portion 620 and a vertical portion 610. In one embodiment, the components of upper support 250 are made of a metallic material, such as aluminum or steel.

In one embodiment, vertical portion 610 is hollow and is larger in size than upstanding member 230, such that vertical portion 610 maybe inserted over central upstanding member 230, as shown in FIGS. 3A-3E. In one embodiment, vertical portion 610 is approximately 70 mm long, 50 mm wide and 180 mm tall. In contrast, central upstanding member 230 is smaller in size (for example, 40 mm×40 mm in size).

In one embodiment, vertical portion 610 includes through-hole 617 and central upstanding member 230 includes corresponding through-hole 717. Through-hole 617 and through-hole 717 are aligned when vertical portion 610 is inserted over central upstanding member 230. To removably secure the two members to one another, pin 267 may be inserted into through-hole 617 of vertical portion 610 of upper support 250 and into corresponding through-hole 717 (FIG. 3A) of central upstanding member 230.

In one embodiment, upper portion 620 is the top point of support head 106 (FIG. 3A-3E). Upper portion has arms 622 extending outwards on each of two sides. Arms 622 secure bars 624 at each of two opposite ends of upper portion 620. Upper portion 620 is oriented relative support arm block 225 such that arms 622 of upper portion 620 is perpendicular to arms 220 support arm block 225. As will be explained in greater detail below, each bar 624 is configured to support a hook 1008 of a compensation-strip 110 (see FIGS. 10A-10D)

Reference is made to FIGS. 7A-7F, showing an example embodiment of a base portion 270 of support head 106. Base portion 270 allows for mounting support head 106 on a vertically extending post. Base portion 270 includes a base plate 710 (FIG. 7A) for securing support head 106 to a vertically extending post, central upstanding member 230, and a retaining spring 730 (FIGS. 7C-7G). In one embodiment, the components of base portion 270 are made of a metallic material, such as aluminum or steel.

Central upstanding member 230 is an elongate member. In one embodiment, central upstanding member 230 may include an upper segment 722 with a rectangular profile and a lower segment 720 with a circular profile. For example, central upstanding member 230 may be approximately 340 mm tall and may have an upper segment 722 that is approximately 40 mm long, 40 mm wide and a lower segment 720 with a diameter of approximately 40 mm. In one embodiment, central upstanding member 230 is made of a metallic material, such as aluminum or steel. In one embodiment, central upstanding member 230 is hollow.

In one embodiment, central upstanding member 230 has cylindrical protrusions 265 attached at a bottom portion thereof to create an area of increased thickness towards the bottom portion of central upstanding member 230. In one embodiment, each cylindrical protrusion 265 is 10 mm thick and has a diameter of about 20 mm.

Base plate 710 has a void 715 in the center thereof. Central upstanding member 230 extends through void 715 of base plate 710 such that a lower segment 720 of central upstanding member 230 extends below base plate 710, and an upper segment 722 of central upstanding member 230 is above base plate 710. The central upstanding member 230 may be secured to base plate 710 at void 715, for example, by welding.

Figure 7A:
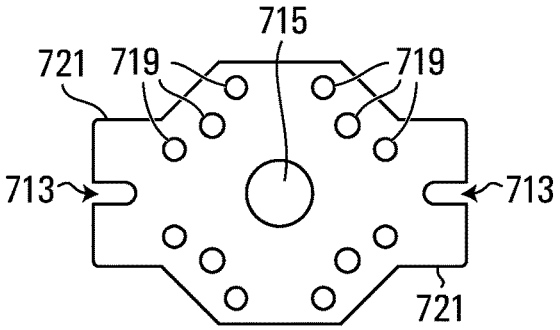
FIG. 7A is top view of a base plate for use with the support of FIG. 3A in accordance with an example embodiment.
Figure 7B:
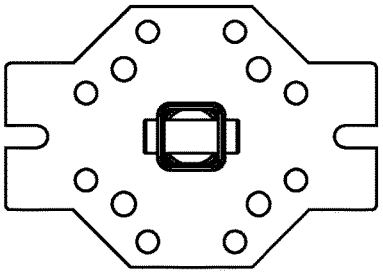
FIG. 7B is a top view of a base portion for use with the support of FIG. 3A in accordance with an example embodiment.
Figure 7F:
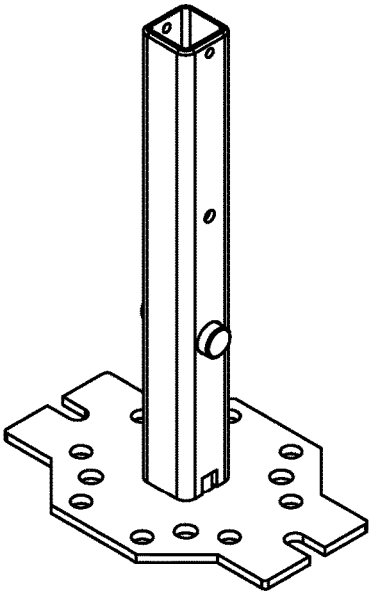
FIG. 7F is a top-perspective view of the base portion of FIG. 7B.
Figure 7C:
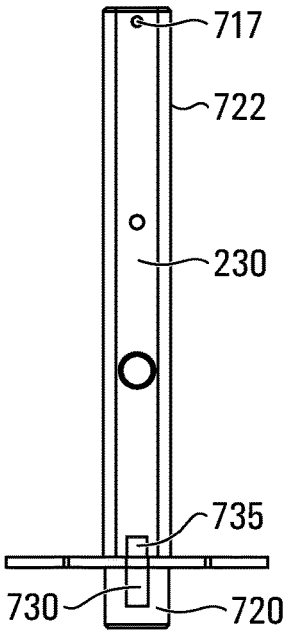
FIGS. 7C-7E are side views of the base portion of FIG. 7B.
Figure 7D:
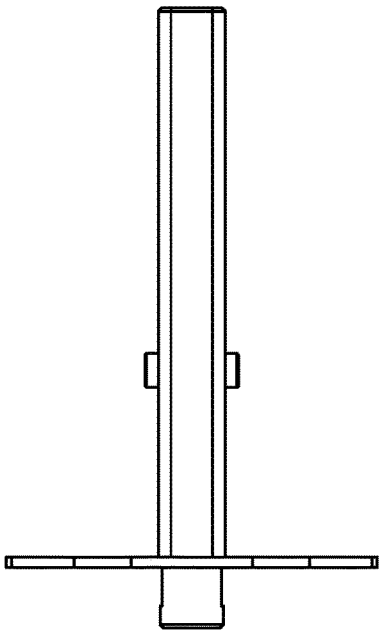
Figure 7E:
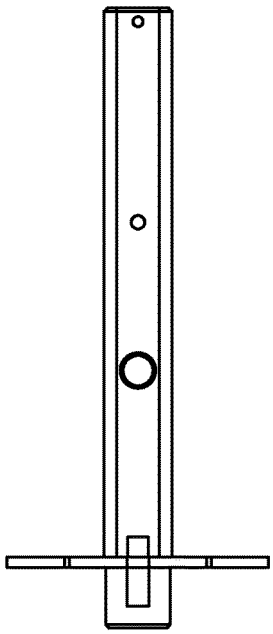
Figure 7G:
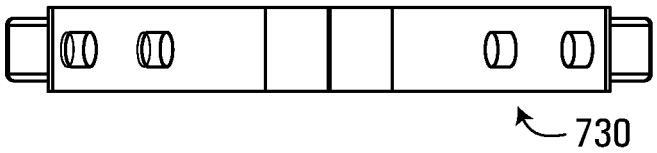
FIG. 7G is a top view of a retaining spring for use with the base portion of FIG. 7B in accordance with an example embodiment.

Base plate 710 may also be shaped to prevent beams from hitting support 105 which supports the beam. As shown in FIG. 7A, base plate 710 has extension portions 721 on each side thereof. In use, extension portions 721 are aligned with beams 108. Thus, when only one end of beam 108 is supported, extension portions 721 may provide a barrier preventing the beam 108 from hitting the base portion 104 of support 105. In one embodiment, extension portions 721 extend by approximately 100 mm in each direction from the center of base plate 710.

In one embodiment, base portion 270 may be removably mounted on top of a vertically extending post (not shown). To allow for mounting, base plate 710 has notches 713 at each side thereof and through-holes 719 (FIG. 7A), which may provide convenient points to screw base plate 710 to the top of a vertically extending post (not shown). Further, lower segment 720 of central upstanding member 230 may be received in a void (not shown) of vertically extending post (not shown) for added stability. In one embodiment, the lower segment 720 is approximately 130 mm long.

In one embodiment, the entirety of central upstanding member 230 may be positioned above base plate 710 such that there is no lower segment 720 to allow support head 106 to be mounted on a vertically extending post having no corresponding void.

Figure 7H:
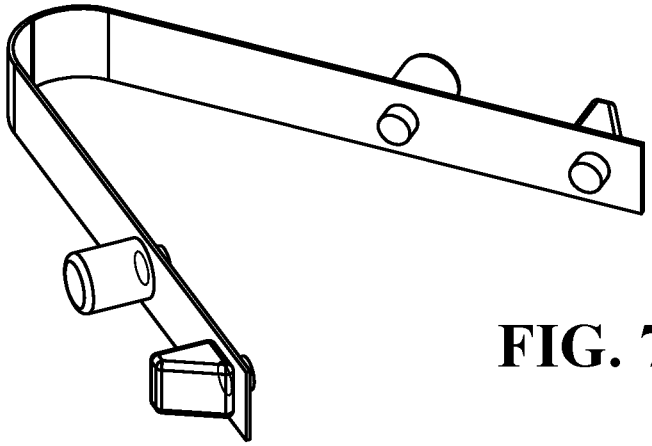
FIG. 7H is a perspective view of the retaining spring of FIG. 7G.
Figure 7I:
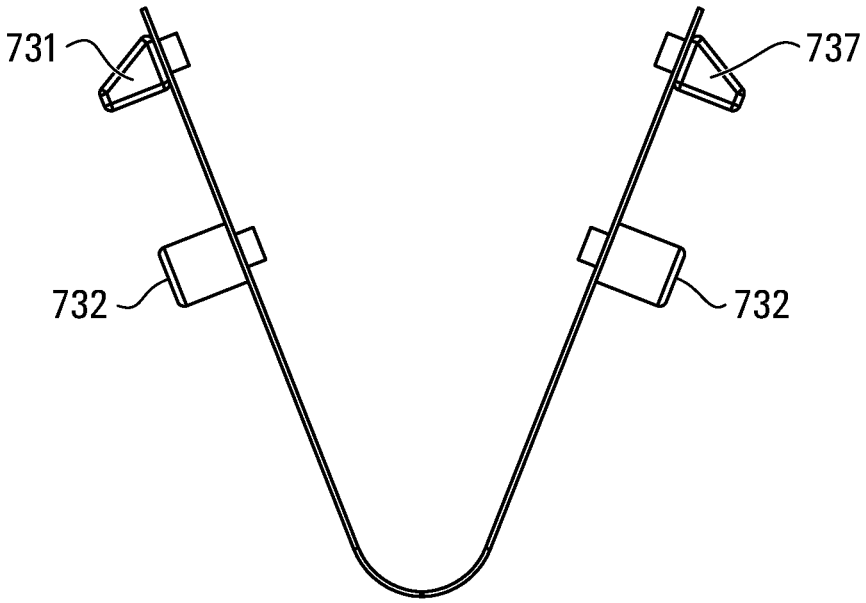
FIG. 7I is a side view of the retaining spring of FIG. 7G.

In one embodiment, a V-shaped retaining spring 730 (see FIGS. 7G to 7I) is positioned within the hollow center of central upstanding member 230 for securing base portion 270 to the top of a vertically extending post (not shown). Retaining spring 730 has a bottom notch 737 and a top notch 732 on the outer side of each of its prongs. The retaining spring 730 is made of a resilient material so as to press outwardly against the interior of a void of vertically extending post which receives lower segment 720. For example, the retaining spring 730 may be made of steel.

Bottom notches 737 are configured to protrude through opening 735 in central upstanding member 230 to engage the interior of the void of vertically extending post (not shown) which receives lower segment 720 of central upstanding member 230, whilst top notches 732 protrude though openings 735 and further protrude through central void 715 of base plate 710 (FIGS. 7C-7F).

To remove support head 106 from a vertically extending post (not shown), top notches 732 may be struck to de-engage the bottom notches from pressing the interior of the void of vertically extending post. Retaining spring 730 may thus, in some embodiments, allow for attachment and detachment of support head 106 without the use of screws and bolts.

Reference is made to FIGS. 8A-8E, illustrating an example embodiment of a release wedge 260 in isolation. Release wedge 260, in conjunction with protrusions 265 of central upstanding member 230, allows support head 106 to function as a drop-head. In one embodiment, release wedge 260 is approximately 180 mm long, 140 mm wide and 15 mm thick. In one embodiment, release wedge 260 is made of a metallic material, such as aluminum or steel.

As is known in the art, liquid concrete is first poured onto forming panels 102 supported by beams 108 and supports 105. Concrete sets and cures slowly over time and may take a few days to set and several weeks to fully cure. Forming panels 102 can usually be removed within a matter of days provided that supports 105 are maintained to support the concrete for a longer time (for example, a week or more, depending on the conditions). Early removal of forming panels 102 and beams 108 may reduce construction costs, as the same parts can be re-used to form higher floors. Thus, in example embodiments, support head 106 may include a release wedge 260 to allow for releasing forming panels 102 and beams 108 prior to removing supports 105.

Release wedge 260 and protrusions 265 provide a mechanism for releasing support arms 220 from a first position at a first height to a second position at a lower height. Release wedge 260 is supported by protrusions 265 in the first position (FIGS. 2A-2F). Once the release wedge 260 is released, release wedge 260 drops closer to base plate 710, as shown in FIGS. 8F-8H. In one embodiment, the vertical distance between the first and second positions is approximately 100 mm.

Release wedge 260 defines a large central void 815. Central void 815 has a wide end and a narrow end. The narrow end has a width that is marginally larger than the width of central upstanding member 230 (for example, in one embodiment, central upstanding member 230 is 40 mm×40 mm; while the narrow end of void 815 has a width of 42 mm). The wide end of central void 815 has a width that is marginally larger than the width of central upstanding member 230 plus the thickness of the two protrusions 265 (for example, in one embodiment, each protrusion 265 is 10 mm thick for a total thickness of 60 mm; while the wide end of void 815 has a width of 62 mm).

Thus, protrusions 265 of to central upstanding member 230 can only pass through the wide end of central void 815 of release wedge 260. To release support arms 220 from the first position at the first height (FIGS. 2A-2F) to the second position at the lower height (FIGS. 8F-8H), a user may strike release wedge 260 laterally, thereby moving it laterally so that protrusions 265 can pass through wide end of central void 815.

Figure 9D:
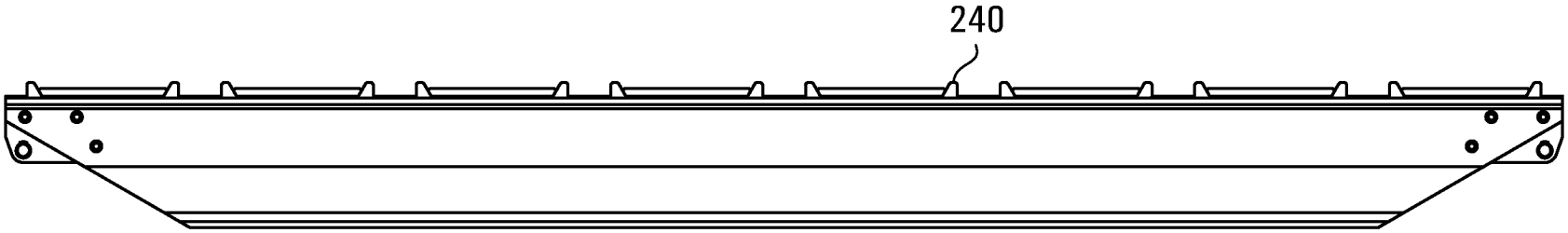
Figure 9E:
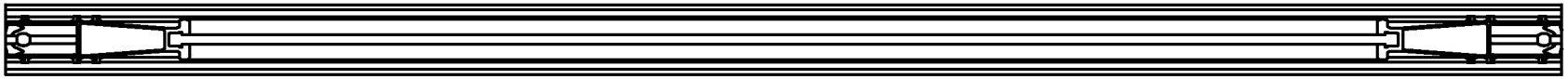
Figure 9I:
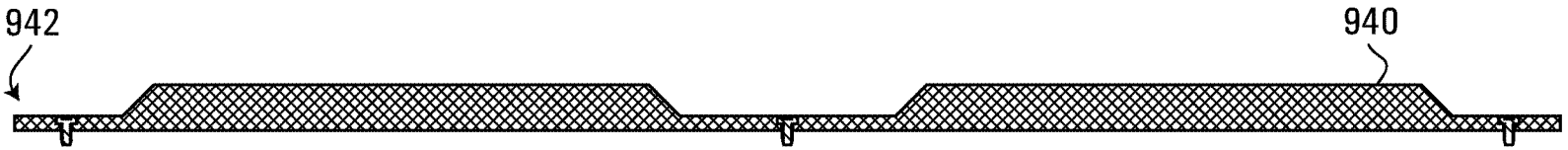
FIG. 9I is a cross-section view of guides of the beam of FIG. 9A.
Figure 9H:
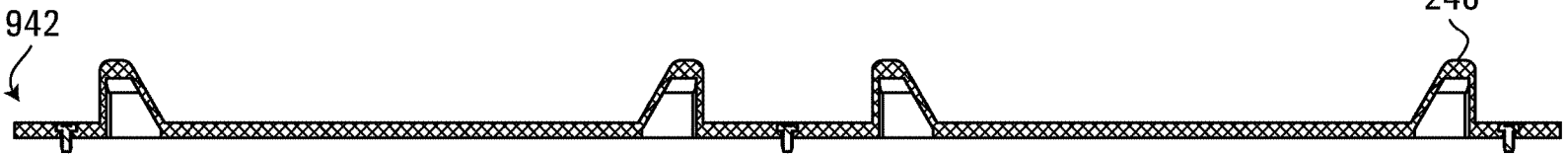
FIG. 9H is a cross-section view of protrusions of the beam of FIG. 9A.
Figure 9F:
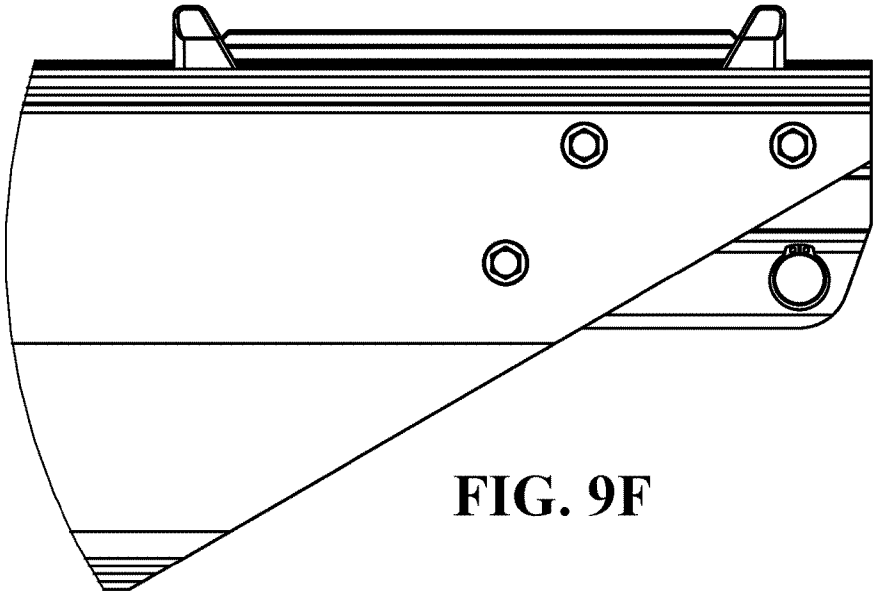
FIG. 9F is a close-up side view of an end of the beam of FIG. 9A.
Figure 9G:
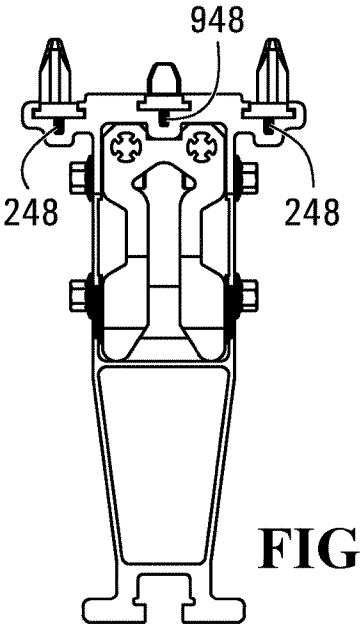
FIG. 9G is a side view of an end of the beam of FIG. 9A.

Reference is made to FIGS. 9A-9J, illustrating an example embodiment of beam 108 in isolation. In one embodiment, beam 108 is a generally hollow elongate member with tapered ends (FIGS. 9D and 9G). The tapered ends may help prevent beam 108 from hitting support 105 which the beam is mounted on.

In one embodiment, beam 108 is approximately 2.4 m long and 10 cm wide. Beams of different lengths may also be used (for example, in one embodiment, different beams 108 may have a length ranging from 4 feet to 8 feet). Beam 108 may be made of a lightweight material that can withstand the weight of concrete (for example, aluminum) to allow for easy manipulation of the beam.

Figure 9J:
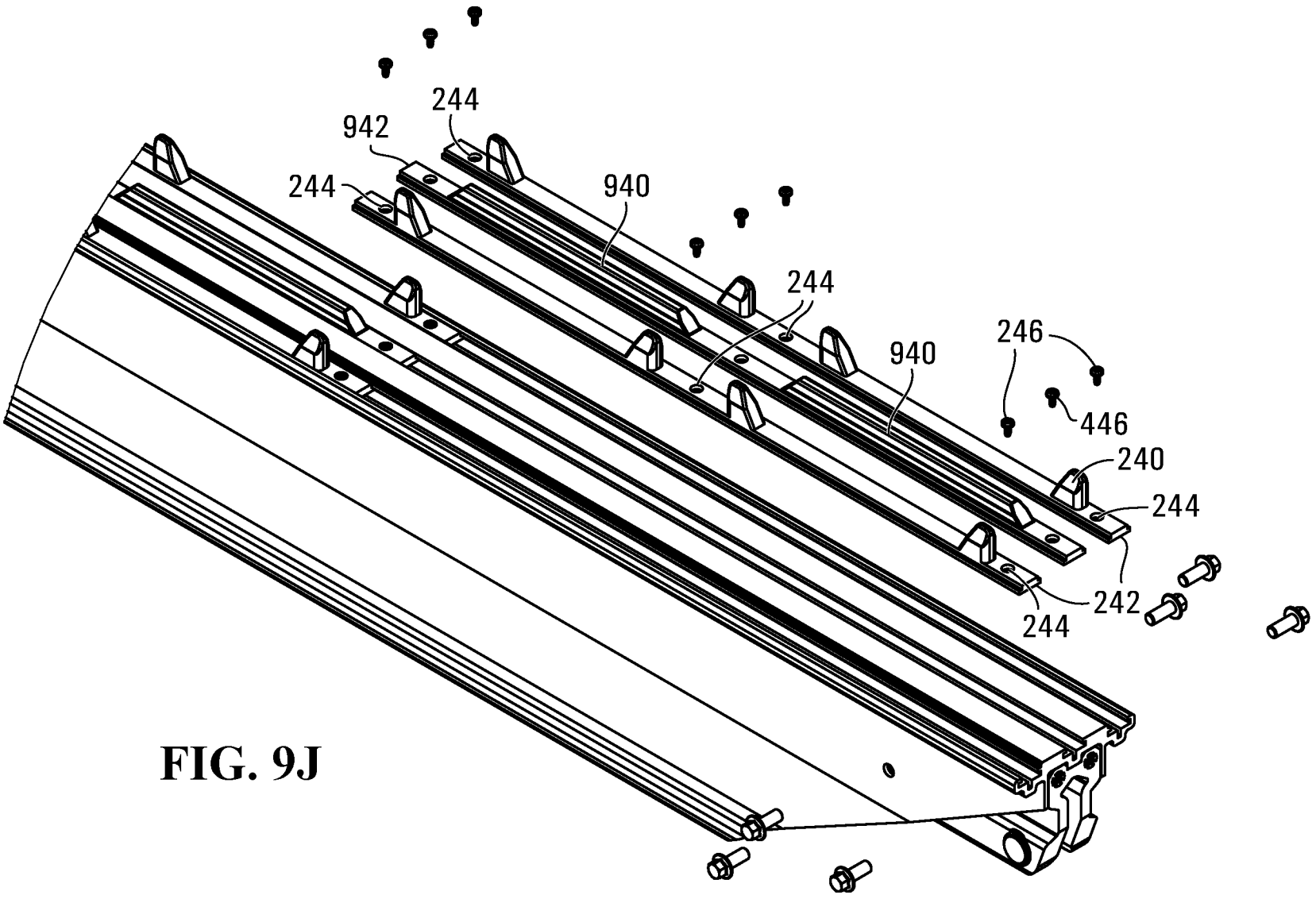
FIG. 9J is an exploded view of the beam of FIG. 9A.

In one example embodiment, beam 108 has a plurality of protrusions 240 extending upwardly from an upper surface thereof. Protrusions 240 may laterally secure forming panels 102 and prevent forming panels 102 from moving laterally. Protrusions 240 are positioned along the length of the upper surface of beam 108 in a pattern that corresponds to the type of forming panels 102 selected for use with beam 108. As shown in FIG. 9J, each of strips 244 have a plurality of protrusions 240 for laterally securing formal panels 102, and a plurality of mounting holes 244 for mounting strips 244 to beam 108. For example, screws 246 may be used to attach strips 244 to beam 108 via corresponding mounting holes 248 on beam 108.

In one embodiment, beam 108 has attached thereon a plurality of guides 940 extending upwardly from the upper surface of beam 108. Guides 940 are positioned along the length of the upper surface of beam 108 at the center to guide forming panels 102 into position. As shown in FIG. 9J, strip 942 has a plurality of guides 940 for guiding forming panels 102 into position and a plurality of mounting holes 944 for mounting strip 942 to beam 108. For example, screws 946 may be used to attach strip 942 to beam 108 via corresponding mounting holes 948 on beam 108.

In one example embodiment, beam 108 has attached to each end a saddle member 915 (shown in isolation in FIG. 9B), which protrudes outwardly. Saddle member 915 has two opposing side plates 910 which may be secured to an end or proximate an end of beam 108. For example, side plates 910 may be welded, riveted, or screwed to beam 108.

Side plates 910 support mounting pin 222 in position proximate to the end of beam 108. Mounting pin 222 may, for example, be welded to each of side plates 910 such that mounting pin 222 protrudes perpendicularly from beam 108. As previously discussed, mounting pin 222 supports beam 108 on a support arm 220 of support 108.

In one embodiment, mounting pin 222 is made of a metallic material, such as aluminum or steel. In one embodiment, mounting pin 222 is cylindrical in shape and is approximately 70 mm long and has a diameter of 20 mm. Notably, the diameter of mounting pin 222 may be selected in dependence on the material used (for example, a less stiff material, such as aluminum, may require mounting pin 222 to have added thickness to properly support beam 108).

Figure 10A:
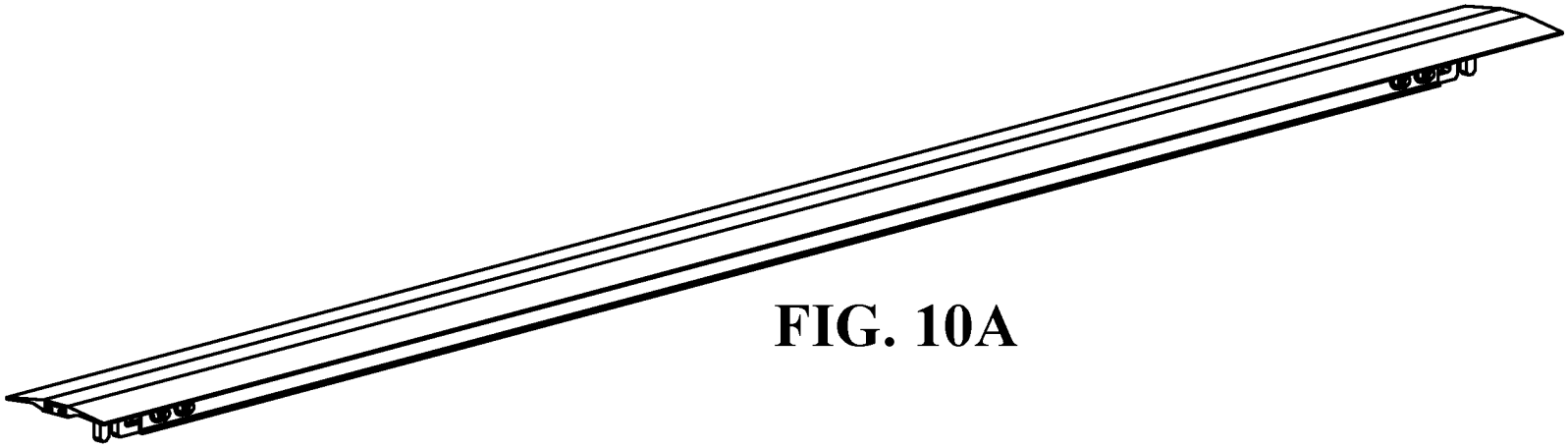
FIG. 10A is a top-perspective view of a compensation-strip for use with the formwork system 100 in accordance with an example embodiment.

Reference is now made to FIGS. 10A and 19B, illustrating an example embodiment of compensation-strip 110 in isolation, and FIG. 10, illustrating an example embodiment of compensation-strip 110 as supported by upper support 250 of support head 106.

In one embodiment, compensation-strip 110 includes a panel 1002 mounted to a body 1004. The length of panel 1002 is selected to match the width of an associated forming panel 102. The width of panel 1002 is selected to span the gap 112 between adjacent panels 102 that form around support heads 106. As depicted in FIGS. 2C-2E, the width of panel 1002 is sufficient to span gap 112, regardless of the orientation of adjacent beams 108 supported by support 105. In one embodiment, panel 1002 is made of an elastomer.

Figure 10B:
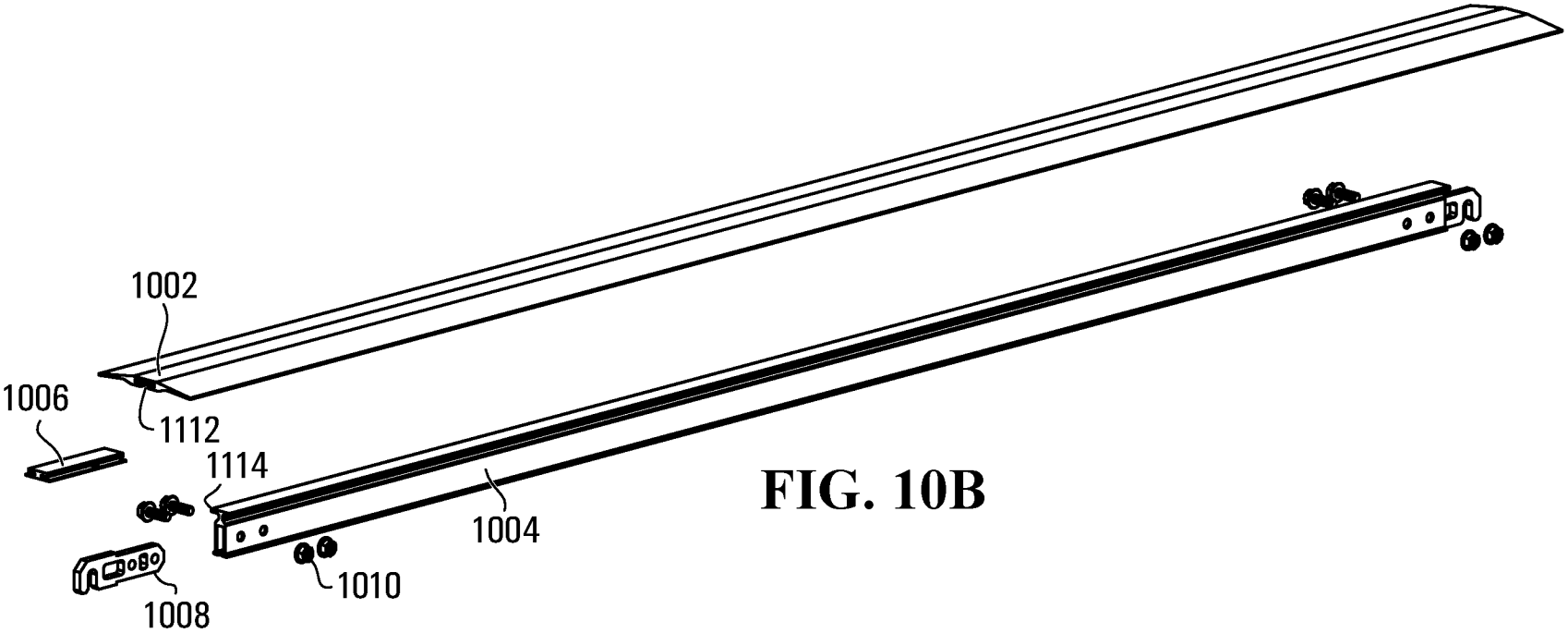
FIG. 10B is an exploded view of the compensation-strip of FIG. 10A.

The body 1004 of compensation-strip 110 is a rigid elongate member for supporting panel 1002. In one embodiment, body 1004 is made of a metallic material, such as aluminum or steel. In one embodiment, body 1004 is hollow for receiving hooks 1008 at either ends. As depicted in FIG. 10B, hooks 1008 may be partially inserted within body 1004 and secured to body 1004 by screws 1010.

Panel 1002 and body 1004 are connected together by a tongue and groove system. In an embodiment, tongue 1114 of body 1004 slides into groove 1112 of panel 1002 to secure panel 1002 to body 1004. Stoppers 1006 may be provided at the ends of panel 1002 and 1004 to prevent panel 1002 from sliding off body 1004. Stopper 1006 may be configured to interlock with and frictionally engage the tongue and groove system of panel 1002 and body 1004. Further, stopper 1006 may be bound to panel 1002 or body 1004, for example, by an adhesive.

Figure 10C:
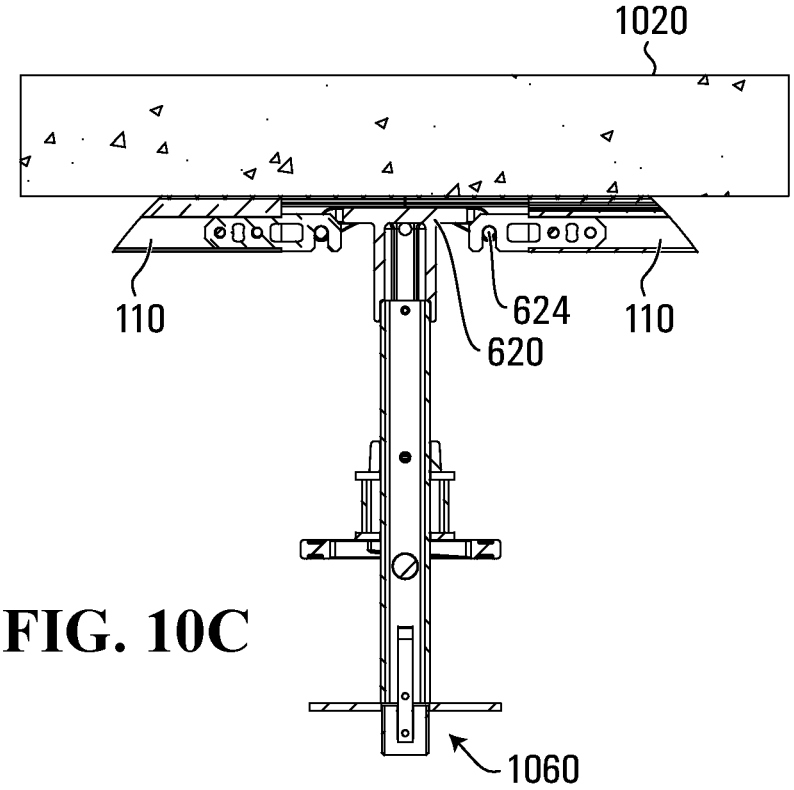
FIG. 10C is a close-up side view of the formwork system 100 in another position in accordance with an example embodiment.
Figure 10D:
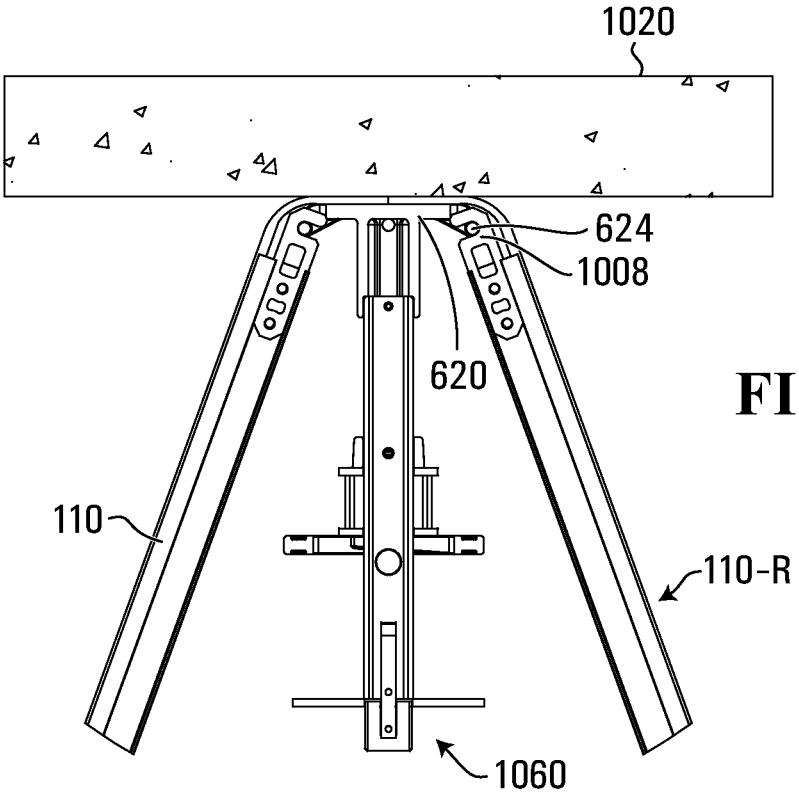
FIG. 10D is a close-up cross-section view of the form work systems 100 in yet another position in accordance with an example embodiment.

In use, hook 1008 hooks onto bar 624 of upper portion 620 of upper support 250 of support head 106 and the edges of panel 1002 rest on adjacent forming panels 102 (FIGS. 2C-2E, 10C and 10D). As described above, upper portion 620 is oriented relative support arm block 225 such that arms 622 of upper portion 620 is perpendicular to arms 220 support arm block 225. Thus, arms 622 of upper portion 620 are perpendicular to support arms 220 of support arm block 225, and compensation-strips 110 are perpendicular to the direction of beams 108. As illustrated in FIGS. 2C to 2E, panel 1002 is flexible and may flex to accommodate various incline of adjacent beams 108. For example, compensation-strip 110 in FIG. 2C is oriented to accommodate a 'valley' created by beams 108-L and 108-R, compensation-strip 110 in FIG. 10D is oriented to accommodate a 'ramp' created by beams 108-L and 108-R, and compensation-strip 110 in FIG. 10E is oriented to accommodate a 'peak' created by beams 108-L and 108-R.

FIGS. 10C and 10D depict compensation-strips 100 supported by upper portion 620 of upper support 250 of a support head 106. In FIGS. 10C and 10D, concrete 1020 has cured and solidified, and the forming panels and beams (not shown) that previously supported concrete 1020 have been removed. Hook 1008 is sized and shaped to fit with bar 624 of upper portion 620, and hook 1008 and bar 624 together forms a hinge joint. When hook 1008 is supported by bar 624, hook 1008 may rotate about bar 624, but will not shift laterally relative to bar 624.

In an embodiment as depicted in FIGS. 10C and 10D, panel 1002 overhangs hook 1008 and upper portion 620. Thus, panels 1002 of compensation-strips 100 separate the upper surface of upper portion 620 of support head 106 from concrete 1020 and there is no gap between adjacent compensation-strips 110.

In FIG. 10D, the support heads (not shown) supporting the opposite ends of compensation-strips 110 have been removed and compensation-strips 110 are supported only at one end by support head 106. As compensation-strips 110 move from the level position of FIG. 10C to the sloped position of FIG. 10D, hook 1008 rotates about bar 624. Notably, panels 1002 of compensation strips 110 are flexible and stretchable, such that no gap is introduced between compensation-strips 110 as they move from a level position to a sloped position.

Of course, the above described embodiments are intended to be illustrative only and in no way limiting. The described embodiments are susceptible to many modifications of form, arrangement of parts, details and order of operation. The invention is intended to encompass all such modification within its scope, as defined by the claims.

The invention claimed is:

1. A formwork system for supporting one or more forming panels to form a generally horizontal concrete surface, said formwork system comprising:

a plurality of supports each comprising a vertically extending post;

a drop head mounted on the vertically extending post, the drop head comprising opposite arms, each one of the arms for supporting an end of a beam supported by said each support and another one of the supports positioned adjacent to said each support;

said each arm comprising a socket at a defined distance from said vertically extending post, for receiving a mounting pin on the beam;

wherein the socket and the mounting pin form a hinged joint connecting the beam to the support and permitting rotation of the mounting pin about a pin axis while retaining the received mounting pin in the socket so that the beam is pivotable about the pin axis both clockwise and counterclockwise to incline or decline when supported by the drop head, wherein the drop head is configured to allow lateral shift of the end of the beam relative to the post in response to pivoting of the beam.

2. The formwork system of claim 1, wherein the socket has a generally semi-circular cross-section.

3. The formwork system of claim 2, wherein on the opposite arms are formed at equal lateral distances from the vertically extending post.

4. The formwork system of claim 1, further comprising a compensation strip mounted to two laterally adjacent ones of said plurality of supports, to cover a gap between forming panels resting on beams supported by the two laterally adjacent supports.

5. The formwork system of claim 1, wherein the beam is inclinable or declinable by an angle of between −5 degree and +5 degree from the horizontal when supported on said drop head.

6. The formwork system of claim 1, wherein said drop head is mounted on a height adjustable vertical prop.

7. The formwork system of claim 1, wherein said drop head is vertically moveable on said vertically extending post.

8. The formwork system of claim 4, wherein the compensation strip comprises an elastomeric panel.

9. The formwork system of claim 8, wherein said compensation strip comprises a rigid central member on which said elastomeric panel is mounted.

10. The formwork system of claim 9, wherein said compensation strip further comprises first and second mounting hooks for mounting said compensation strip to said two laterally adjacent supports.

11. The formwork system of claim 1, wherein said each arm comprises a rounded portion forming the socket and an inclined and curved portion having a groove adjacent to the rounded portion.

12. The formwork system of claim 1, wherein said each arm comprises a rounded portion forming the socket, a first inclined portion extending from the rounded portion, a vertical portion extending up from the first inclined portion, and a second inclined portion extending from the vertical portion.

13. The formwork system of claim 1, wherein the socket and the mounting pin comprise complementary rounded contact surfaces.

* * * * *